US010531219B2

(12) United States Patent
Laaksonen

(10) Patent No.: US 10,531,219 B2
(45) Date of Patent: Jan. 7, 2020

(54) SMOOTH RENDERING OF OVERLAPPING AUDIO-OBJECT INTERACTIONS

(71) Applicant: Nokia Technologies Oy, Espoo (FI)

(72) Inventor: Lasse Juhani Laaksonen, Tampere (FI)

(73) Assignee: Nokia Technologies Oy, Espoo (FI)

( * ) Notice: Subject to any disclaimer, the term of this patent is extended or adjusted under 35 U.S.C. 154(b) by 0 days.

(21) Appl. No.: 15/463,513

(22) Filed: Mar. 20, 2017

(65) Prior Publication Data

US 2018/0270602 A1 Sep. 20, 2018

(51) Int. Cl.
*H04S 7/00* (2006.01)

(52) U.S. Cl.
CPC ..... *H04S 7/303* (2013.01); *H04S 2400/11* (2013.01)

(58) Field of Classification Search
CPC ..... G10L 19/008; G10L 19/032; G10L 19/20; H04S 2400/03; H04S 2400/11; H04S 3/02; H04S 2420/03; H04S 3/008; H04S 2400/01; H04S 2420/01; H04S 7/30; H04S 7/303
USPC ..... 381/306, 310, 59, 303, 22, 23
See application file for complete search history.

(56) References Cited

U.S. PATENT DOCUMENTS

| | | | |
|---|---|---|---|
| 5,633,993 | A | 5/1997 | Redmann |
| 5,754,939 | A | 5/1998 | Herz |
| 6,151,020 | A | 11/2000 | Palmer |
| 6,330,486 | B1 | 12/2001 | Padula ..... 700/94 |
| 7,266,207 | B2 | 9/2007 | Wilcock et al. |
| 7,492,915 | B2 | 2/2009 | Jahnke |
| 8,187,093 | B2 | 5/2012 | Hideya et al. |
| 8,189,813 | B2 | 5/2012 | Muraoka et al. |
| 8,411,880 | B2 | 4/2013 | Wang et al. |
| 8,509,454 | B2 | 8/2013 | Kirkeby et al. |
| 8,831,255 | B2 | 9/2014 | Crawford et al. |

(Continued)

FOREIGN PATENT DOCUMENTS

| | | |
|---|---|---|
| EP | 2688318 A1 | 1/2014 |
| GB | 2540175 A | 1/2017 |

(Continued)

OTHER PUBLICATIONS

Micah T. Taylor, Anish Chandak, Lakulish Antani, Dinesh Manocha, "*RESound: Interactive Sound Rendering for Dynamic Virtual Enviroments*" MM'09, Oct. 19-24, 2009, Beijing, China. http://gamma.cs.unc.edu/Sound/RESound/.

(Continued)

*Primary Examiner* — Alexander Krzystan
(74) *Attorney, Agent, or Firm* — Harrington & Smith

(57) ABSTRACT

A method including, detecting an overlap between at least two waveform renderings, wherein the at least two waveform renderings comprise an audio object, determining at least one difference between the at least two waveform renderings for the audio object when the overlap is detected, determining a rendering modification decision for the audio object associated with the at least one difference, processing at least one of the at least two waveform renderings dependent on the rendering modification decision so as to introduce an effect related to the determined at least one difference, and performing a modified rendering with the processed at least one of the at least two waveform renderings comprising the effect for the audio object.

20 Claims, 12 Drawing Sheets

(56) References Cited

U.S. PATENT DOCUMENTS

| | | | | |
|---|---|---|---|---|
| 8,990,078 | B2 | 3/2015 | Nakadai et al. | |
| 9,161,147 | B2 | 10/2015 | Korn | |
| 9,179,232 | B2 | 11/2015 | Jarske et al. | |
| 9,197,979 | B2 | 11/2015 | Lemieux et al. | |
| 9,215,539 | B2 | 12/2015 | Kim et al. | |
| 9,271,081 | B2 | 2/2016 | Corteel et al. | |
| 2002/0150254 | A1 | 10/2002 | Wilcock et al. | |
| 2006/0025216 | A1 | 2/2006 | Smith | 463/35 |
| 2008/0144864 | A1 | 6/2008 | Huon | |
| 2008/0247567 | A1 | 10/2008 | Kjolerbakken et al. | |
| 2009/0138805 | A1 | 5/2009 | Hildreth | |
| 2009/0262946 | A1 | 10/2009 | Dunko | |
| 2010/0098274 | A1 | 4/2010 | Hannemann et al. | |
| 2010/0119072 | A1 | 5/2010 | Ojanpera | |
| 2010/0208905 | A1* | 8/2010 | Franck | H04S 3/008 381/59 |
| 2011/0002469 | A1 | 1/2011 | Ojala | |
| 2011/0129095 | A1 | 6/2011 | Avendano et al. | |
| 2011/0166681 | A1 | 7/2011 | Lee et al. | |
| 2012/0027217 | A1 | 2/2012 | Jun et al. | |
| 2012/0230512 | A1 | 9/2012 | Ojanpera | |
| 2012/0232910 | A1 | 9/2012 | Dressler et al. | 704/500 |
| 2012/0295637 | A1 | 11/2012 | Hannuksela | |
| 2013/0114819 | A1 | 5/2013 | Melchior et al. | |
| 2013/0259243 | A1 | 10/2013 | Herre et al. | |
| 2013/0321586 | A1 | 12/2013 | Kirk et al. | |
| 2014/0010391 | A1 | 1/2014 | Ek et al. | |
| 2014/0153753 | A1 | 6/2014 | Crockett | 381/307 |
| 2014/0285312 | A1 | 9/2014 | Laaksonen et al. | |
| 2014/0328505 | A1 | 11/2014 | Heinemann et al. | |
| 2014/0350944 | A1 | 11/2014 | Jot et al. | |
| 2015/0002388 | A1 | 1/2015 | Weston et al. | |
| 2015/0003616 | A1 | 1/2015 | Middlemiss et al. | |
| 2015/0055937 | A1 | 2/2015 | Van Hoff et al. | 386/285 |
| 2015/0063610 | A1 | 3/2015 | Mossner | |
| 2015/0078594 | A1 | 3/2015 | McGrath et al. | 381/300 |
| 2015/0116316 | A1 | 4/2015 | Fitzgerald et al. | 345/419 |
| 2015/0245153 | A1 | 8/2015 | Malak | 381/57 |
| 2015/0263692 | A1 | 9/2015 | Bush | |
| 2015/0302651 | A1 | 10/2015 | Shpigelman | |
| 2015/0316640 | A1 | 11/2015 | Jarske et al. | |
| 2016/0050508 | A1* | 2/2016 | Redmann | H04S 7/30 381/303 |
| 2016/0084937 | A1 | 3/2016 | Lin | |
| 2016/0112819 | A1 | 4/2016 | Mehnert et al. | |
| 2016/0125867 | A1 | 5/2016 | Jarvinen et al. | |
| 2016/0142830 | A1 | 5/2016 | Hu | |
| 2016/0150267 | A1 | 5/2016 | Strong | |
| 2016/0150345 | A1 | 5/2016 | Jang | |
| 2016/0192105 | A1 | 6/2016 | Breebaart et al. | |
| 2016/0212272 | A1 | 7/2016 | Srinivasan et al. | |
| 2016/0227337 | A1 | 8/2016 | Goodwin et al. | |
| 2016/0227338 | A1 | 8/2016 | Oh et al. | |
| 2016/0266865 | A1 | 9/2016 | Tsingos | |
| 2016/0300577 | A1 | 10/2016 | Fersch et al. | |
| 2016/0313790 | A1 | 10/2016 | Clement et al. | |
| 2017/0077887 | A1 | 3/2017 | You | |
| 2017/0110155 | A1 | 4/2017 | Campbell et al. | |
| 2017/0150252 | A1 | 5/2017 | Trestain et al. | |
| 2017/0165575 | A1 | 6/2017 | Ridihalgh et al. | |
| 2017/0169613 | A1 | 6/2017 | VanBlon et al. | |
| 2017/0208415 | A1 | 7/2017 | Ojala | |
| 2017/0223478 | A1 | 8/2017 | Jot et al. | |
| 2017/0230760 | A1 | 8/2017 | Sanger et al. | |
| 2017/0295446 | A1 | 10/2017 | Thagadur Shivappa | |
| 2017/0366914 | A1* | 12/2017 | Stein | H04S 7/304 |

FOREIGN PATENT DOCUMENTS

| | | | |
|---|---|---|---|
| WO | WO-2009092060 | A2 | 7/2009 |
| WO | WO-2009128859 | A1 | 10/2009 |
| WO | WO-2011020065 | A1 | 2/2011 |
| WO | WO-2011020067 | A1 | 2/2011 |
| WO | WO-2014168901 | A1 | 10/2014 |
| WO | WO-2015152661 | A1 | 10/2015 |
| WO | WO-2016014254 | A1 | 1/2016 |
| WO | WO-2017120681 | A1 | 7/2017 |

OTHER PUBLICATIONS

"Unity 3D Audio"; Nov. 8, 2011; whole document (9 pages).

Wozniewski, M. et al.; "User-Specific Audio Rendering and Steerable Sound for Distributed Virtual Environments"; Proceedings of the 13th International Conference on Auditory Display; Montréal, Canada; Jun. 26-29, 2007; whole document (4 pages).

Hatala, Marek et al., "Ontology-Based User Modeling in an Augmented Audio Reality System for Museums", http://citeseerx.ist.psu.edu/viewdoc/download?doi=10.1.1.91.5712&rep=rep1&type=pdf; Aug. 29, 2016, 38 pgs.

Gunel, Banu et al., "Spatial Synchronization of Audiovisual Objects by 3D Audio Object Coding", IEEE 2010, pp. 460-465; https://www.researchgate.net/profile/E_Ekmekcioglu/publication/251975482_Spatial_synchronization_of_audiovisual_objects_by_3D_audio_object_coding/links/54e783660cf2f7aa4d4d858a.pdf>; 2010.

Galvez, Marcos F. Simon; Menzies, Dylan; Mason, Rusell; Fazi, Filippo Maria "Object-Based Audio Reproduction Using a Listener-Position Adaptive Stereo System" University of Southhampton <http://www.aes.org/e-lib/browse,cfm?elib=18516>.

Simon Galvez, Marcos F.; Menzies, Dylan; Fazi, Filippo Maria; de Campos, Teofilo; Hilton, Adrian "A Listener Position Adaptive Stereo System for Object-Based Reproduction" http://www.aes.org/e-lib/browse.cfm?elib=17670 dated May. 6, 2015.

Cameron Faulkner, "*Google's Adding Immersive Audio to your Virtual Reality Worlds*"http://www.in.techradar.com/news/misc/googlesaddingimmersiveaudiotoyourvrworlds/articleshow/57191578.cms retrieved Feb. 16, 2017.

Alessandro Pieropan, Giampiero Salvi, Karl Pauwels, Hedvig Kjellstrom Audio-Visual Classification and Detection of Human Manipulation Actions [https://www.csc.kth.se/-hedvig/publications/iros_14.pdf] retrieved Sep. 29, 2017.

Anil Camci, Paul Murray, Angus Graeme Forbes, *"A Web-based UI for Designing 3D Sound Objects and Virtual Sonic Enviroments"* Electronic Visualization Laboratory, Department of Computer Science, University of Illinois at Chicago retrieved May 16, 2017.

Henney Oh "The Future of VR Audio-3 Trends to Track This Year" dated Jul. 4, 2017.

Carl Schissler, Aaron Nicholls, and Ravish Mehra "Efficient HRTF-Based Spatial Audio for Area and Volumetric Sources" [retrieved Jan. 31, 2018].

Hasan Khaddour, Jiri Schimmel, Frantisek Rund "A Novel Combined System of Direction Estimation and Sound Zooming of Multiple Speakers" Radioengineering, vol. 24, No. 2, Jun. 2015.

Li, Loco Radio Designing High Density Augmented Reality Audio Browsers, PhD Thesis Final, MIT, 2014.

* cited by examiner

SMOOTH RENDERING OF OVERLAPPING AUDIO-OBJECT INTERACTIONS

BACKGROUND

Technical Field

The exemplary and non-limiting embodiments relate generally to rendering of free-viewpoint audio for presentation to a user using a spatial rendering engine.

Brief Description of Prior Developments

Free-viewpoint audio allows for the user to move around in the audio (or generally, audio-visual or mediated reality) space and experience it correctly according to his location and orientation in it. The spatial audio may consist, for example, of a channel-based bed and audio objects. While moving in the space, the user may come into contact with audio objects, he may distance himself considerably from other objects, and new objects may also appear. Not only is the listening/rendering point thus adapting to user's movement, but the user may interact with the audio objects, and the audio content may otherwise evolve due to the changes relative to the rendering point or user action.

SUMMARY

The following summary is merely intended to be exemplary. The summary is not intended to limit the scope of the claims.

In accordance with one aspect, an example method comprises, detecting an overlap between at least two waveform renderings, wherein the at least two waveform renderings comprise an audio object, determining at least one difference between the at least two waveform renderings for the audio object when the overlap is detected, determining a rendering modification decision for the audio object associated with the at least one difference, processing at least one of the at least two waveform renderings dependent on the rendering modification decision so as to introduce an effect related to the determined at least one difference, and performing a modified rendering with the processed at least one of the at least two waveform renderings comprising the effect for the audio object.

In accordance with another aspect, an example apparatus comprises at least one processor; and at least one non-transitory memory including computer program code, the at least one memory and the computer program code configured to, with the at least one processor, cause the apparatus to: detect an overlap between at least two waveform renderings, wherein the at least two waveform renderings comprise an audio object, determine at least one difference between the at least two waveform renderings for the audio object when the overlap is detected, determine a rendering modification decision for the audio object associated with the at least one difference, process at least one of the at least two waveform renderings dependent on the rendering modification decision so as to introduce an effect related to the determined at least one difference, and perform a modified rendering with the processed at least one of the at least two waveform renderings comprising the effect for the audio object.

In accordance with another aspect, an example apparatus comprises a non-transitory program storage device readable by a machine, tangibly embodying a program of instructions executable by the machine for performing operations, the operations comprising: detecting an overlap between at least two waveform renderings, wherein the at least two waveform renderings comprise an audio object, determining at least one difference between the at least two waveform renderings for the audio object when the overlap is detected, determining a rendering modification decision for the audio object associated with the at least one difference, processing at least one of the at least two waveform renderings dependent on the rendering modification decision so as to introduce an effect related to the determined at least one difference, and performing a modified rendering with the processed at least one of the at least two waveform renderings comprising the effect for the audio object.

BRIEF DESCRIPTION OF THE DRAWINGS

The foregoing aspects and other features are explained in the following description, taken in connection with the accompanying drawings, wherein.

DETAILED DESCRIPTION OF EMBODIMENTS

Figure 1:
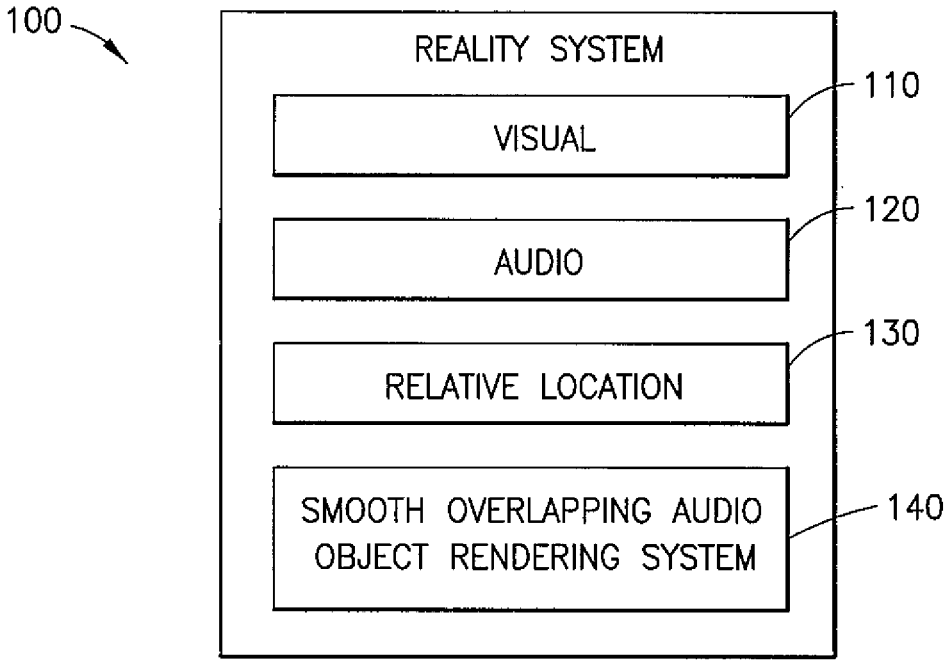
FIG. 1 is a diagram illustrating a reality system comprising features of an example embodiment.

Referring to FIG. 1, a diagram is shown illustrating a reality system 100 incorporating features of an example embodiment. The reality system 100 may be used by a user for augmented-reality (AR), virtual-reality (VR), or presence-captured (PC) experiences and content consumption, for example, which incorporate free-viewpoint audio. Although the features will be described with reference to the example embodiments shown in the drawings, it should be understood that features can be embodied in many alternate forms of embodiments.

The system 100 generally comprises a visual system 110, an audio system 120, a relative location system 130 and a smooth overlapping audio object rendering system 140. The visual system 110 is configured to provide visual images to a user. For example, the visual system 12 may comprise a virtual reality (VR) headset, goggles or glasses. The audio system 120 is configured to provide audio sound to the user, such as by one or more speakers, a VR headset, or ear buds for example. The relative location system 130 is configured to sense a location of the user, such as the user's head for example, and determine the location of the user in the realm of the reality content consumption space. The movement in the reality content consumption space may be based on actual user movement, user-controlled movement, and/or some other externally-controlled movement or pre-determined movement, or any combination of these. The user is able to move in the content consumption space of the free-viewpoint. The relative location system 130 may be able to change what the user sees and hears based upon the user's movement in the real-world; that real-world movement changing what the user sees and hears in the free-viewpoint rendering.

The movement of the user, interaction with audio objects and things seen and heard by the user may be defined by predetermined parameters including an effective distance parameter and a reversibility parameter. An effective distance parameter may be a core parameter that defines the distance from which user interaction is considered for the current audio object. In some embodiments, the effective distance parameter may also be considered a modification adjustment parameter, which may be applied to modification of interactions, as described in U.S. patent application Ser. No. 15/293,607, filed Oct. 14, 2016, which is hereby incorporated by reference. A reversibility parameter may also be considered a core parameter, and may define the reversibility of the interaction response. The reversibility parameter may also be considered a modification adjustment parameter. Although particular modes of audio-object interaction are described herein for ease of explanation, brevity and simplicity, it should be understood that the methods described herein may be applied to other types of audio-object interactions.

The user may be virtually located in the free-viewpoint content space, or in other words, receive a rendering corresponding to a location in the free-viewpoint rendering. Audio objects may be rendered to the user at this user location. The area around a selected listening point may be defined based on user input, based on use case or content specific settings, and/or based on particular implementations of the audio rendering. Additionally, the area may in some embodiments be defined at least partly based on an indirect user or system setting such as the overall output level of the system (for example, some sounds may not be heard when the sound pressure level at the output is reduced). In such instances the output level input to an application may result in particular sounds being not decoded because the sound level associated with these audio objects may be considered imperceptible from the listening point. In other instances, distant sounds with higher output levels (such as, for example, an explosion or similar loud event) may be exempted from the requirement (in other words, these sounds may be decoded). A process such as dynamic range control may also affect the rendering, and therefore the area, if the audio output level is considered in the area definition.

The smooth overlapping audio object rendering system 140 is configured to provide a rendering of free-viewpoint (or free-listening point, six-degrees-of-freedom, etc.) audio for presentation to a user using a spatial rendering engine. In some instances, the smooth overlapping audio object rendering system may also implement audio object spatial modification (for example, via an audio object spatial modification engine).

A rendering (or waveform rendering) is the way an audio object's current properties are turned into a waveform. The waveform may then be presented to a user. At least two renderings may denote an apparent unwanted duplication of the audio object (as opposed to explicit duplicate renderings of independent audio objects for effect) or a lack of clarity regarding a correct way to render the audio object. For example, there may be at least two possible waveforms for an audio object and the renderer may be unclear which of the renderings to present or whether to present all the available waveforms. In some instances, processing or rendering of the waveform signal for presentation may be in frequency domain.

In some instances (use cases), rendering of free-viewpoint audio may include interactions with audio objects in which the renderings overlap in complex or unpredictable ways. For example, when a user is utilizing a spatial audio rendering point extension, such as described in U.S. patent application Ser. No. 15/412,561, filed Jan. 23, 2017, which is hereby incorporated by reference, the user may come in contact and start to interact with an audio object that is already under an interaction from the spatial audio rendering point extension. This may lead to discontinuities in the experience, and in some instances may even cause a part of the rendering to oscillate between at least two rendering stages. In some instances, the smooth overlapping audio object rendering system 140 may be configured to perform smoothing of rendering in two types of conflicting audio-object interactions, or generally renderings: 1) an instance in which an audio object may have at least two simultaneous renderings that must be fused into a single rendering without discontinuities or artefacts, or 2) an instance in which at least two instances of one audio object may both have at least one rendering that is to be fused into a single rendering without discontinuities or artefacts.

U.S. patent application Ser. No. 15/412,561 describes processes that extend the capability of the user to experience the free-viewpoint audio space by implementing an area-based audio rendering in the free-viewpoint audio space. This solves problems related to a user at a first location otherwise being unable to listen to audio related to a second location in the free-viewpoint audio space.

A spatial rendering point extension may allow the user to hear at a higher level (or at all) audio sources that the user otherwise would not hear as well (or at all). The additional audio sources may consist of audio objects that relate to a location of a specific audio object, a specific area in the free-listening point audio space, or an area relative to either of these or the user location itself. The spatial rendering point extension defines at least one point and an area around it for which a secondary spatial rendering is generated. The audio objects included into the at least one secondary spatial rendering may be mixed at their respective playback level (amplification) to the spatial rendering of the user's actual location in the scene. The spatial direction of the said audio objects may be based on the actual direction, or alternatively, a distance parameter may also be modified for at least one of the additional audio objects. Following initialization, the spatial audio rendering point extension may be automatic or user-controlled. The spatial audio rendering point extension may provide a spatial audio focus that includes a capability for a primary user to receive an audio rendering that corresponds to at least a secondary user in a secondary location whose rendering/hearing may be added unto the primary user's rendering (for example, amplify the spatial perception of the first user). The at least one secondary location (the extended spatial rendering point) may thereby define a spatial audio rendering via a proxy.

A proxy-based audio-object interaction based on the spatial rendering point extension may allow the user to interact with distant audio-objects and may thereby provide an extended (or full) spatial rendering experience that the user would otherwise miss due to their current location in the free-viewpoint audio space. When a spatial rendering point extension is used, the spatial rendering engine may consider more than one location for spatial rendering (for example, also some other location than the user's current location). Consequently, in some instances, at least one additional rendering location under consideration may come in contact with audio objects. U.S. patent application Ser. No. 15/293,607 discloses an audio-object interaction detection followed by a rendering modification. The at least one secondary rendering location may act as a proxy for the real rendering location and enable new, indirect audio-object interactions.

Smooth overlapping audio object rendering system 140 may be implemented to smooth rendering of overlapping audio-object interactions that may occur in systems and instances, for example, such as those based on methods described in U.S. patent application Ser. No. 15/293,607 and U.S. patent application Ser. No. 15/412,561.

Smooth overlapping audio object rendering system 140 may provide audio-object processing for free-viewpoint audio rendering. In some instances of free-viewpoint audio, multiple rendering points (at least two rendering points) may contribute to an overall rendering presented to the user and may contain an interaction with a single audio object. The audio object may, in some instances, comprise an audio-visual object.

A single audio object may be interacted with resulting in two types of conflicts: 1) an instance in which an audio object may have at least two simultaneous renderings that must be fused into a single rendering without discontinuities or artefacts, or 2) an instance in which at least two instances of one audio object may both have at least one rendering that is to be fused into a single rendering without discontinuities or artefacts. An audio object may include a single instance, or alternatively an instance such as in case 2) with "at least two instances" of one audio object.

There may be more than one expected rendering for an audio object. This may be defined as an overlap of renderings including at least one audio-object interaction. An overlap may occur when there are at least two instruction sets that may be applied (for example, may be considered) for determining the rendering of a single audio object. The overlap may occur in instances in which a first audio-object interaction which results in a rendering of the audio object to the user is followed by either 1) another directly competing audio-object interaction which results in a different rendering of the audio object to the user (while the first one is still ongoing and these instructions are also being applied), or 2) the original audio object being received (for example, heard) from a different position than the ongoing audio-object interaction rendering is being heard. Thus, the overlap may either be defined as at least two simultaneous renderings of an audio object (that generally should not be duplicated) or as at least two instruction sets being simultaneously considered for an audio object (which may then result in the aforementioned at least two simultaneous renderings).

The overlapping audio interaction (or interactions) may generate discontinuities or other artefacts in the rendering for the user. In some instances, a user may be rendered an audio object instance under an interaction (for example, via a proxy) and the original audio object instance that is not (currently) under an interaction. The rendering conflict may manifest itself prior to beginning of the at least second audio-object interaction of a single audio object due to multiple rendering points. This rendering conflict may however be processed in a similar manner as the case (or time instant) where the at least two audio-object interactions with the single audio object are active.

In order to overcome issues based on the overlapping renderings with at least one audio object interaction, smooth overlapping audio object rendering system 140 may first detect an overlap (or expected overlap) of audio-object interactions between individual renderings. Next, smooth overlapping audio object rendering system 140 may determine a most important difference (or greatest divergence) in the associated renderings, where the most important difference may be defined based on the difference in location of the at least two audio-object renderings and/or the difference in their playback time. For example, two instances (caused by a first audio-object interaction) of a single audio object may have a different rendering location.

In instances in which there is no difference between the at least two waveform renderings, rendering more than one waveform rendering may simply result in a louder volume at the presentation. Thus, no actual modification may be needed in these instances, and one may decide to render a single waveform to maintain correct volume. However, in instances in which there is at least one difference in the at least two waveform renderings, the difference in the at least two waveform renderings may require modification.

Smooth overlapping audio object rendering system 140 may take at least two renderings and fuse them into one either by interpolating or by deciding to use one of them and smoothly removing the at least one other. Smooth overlapping audio object rendering system 140 may use the at least one difference to make this decision. The difference itself may not have a direct effect on the end result (the modified rendering).

Smooth overlapping audio object rendering system 140 is configured to determine a single, stable rendering for the user. Thus, if the difference in location is significant for the rendering, this difference may drive the rendering modification. Smooth overlapping audio object rendering system 140 may analyze particular differences related to the spatial position of the rendering and the playtime of the playback (or even the track that is used) for making the decision between the 'interpolation' and 'handover' modes. Other differences may include various properties and effects used for the renderings such as degree of spatial extent, size of the audio source, directivity, volume, compression, movement or rotation modification parameters, etc. These differences may be analyzed on a metadata level or a waveform level.

Smooth overlapping audio object rendering system 140 may, based on the most important difference, either interpolate between the at least two renderings or fuse the renderings into a single rendering to provide the user with a clear and consistent user experience. In instances in which smooth overlapping audio object rendering system 140 determines an interpolation is to be implemented, smooth overlapping audio object rendering system 140 may implement the interpolation prior to the rendering to the user. In instances in which smooth overlapping audio object rendering system 140 determines that the rendering are to be fused, the fusing of at least two instances into a single rendering will generally be heard by the user as an audio effect. The fusing of the renderings provides the user with an auditory feedback that the two instances are the same.

Smooth overlapping audio object rendering system 140 may thereby prevent some aspects of the rendering presented to the user from being undefined and prevent the user from hearing disturbing effects that the content creator does not mean for the user to hear. Smooth overlapping audio object rendering system 140 may adjust to the complexity of the audio-object interaction renderings, and provide a response that ensures a smooth audio rendering in different instances (as opposed to a single default response that may not work in every case). Smooth overlapping audio object rendering system 140 may thereby smooth rendering of an audio object by reducing abrupt changes in parameters associated with the overlapping renderings. Smooth overlapping audio object rendering system 140 may minimize or eliminate discontinuities, significantly decrease or abrupt changes in parameters associated with an audio object, provide a realistic (or logical) rendering of audio corresponding to a scene or environment, etc.

It should be understood that the free-viewpoint audio experience may include rendering that is, for example, audio-only rendering, audio with augmented reality (AR) content rendering, or a full audio-visual virtual reality (VR) or presence capture (PC) rendering. It should be further understood that while the methods and processes described herein relate to all free-viewpoint audio experiences, they are described mainly in the context of audio-only or audio with AR content rendering for purposes of clarity, simplicity and/or brevity of explanation. In some instances, the methods may implement audio rendering for artificial content only.

Figure 2:
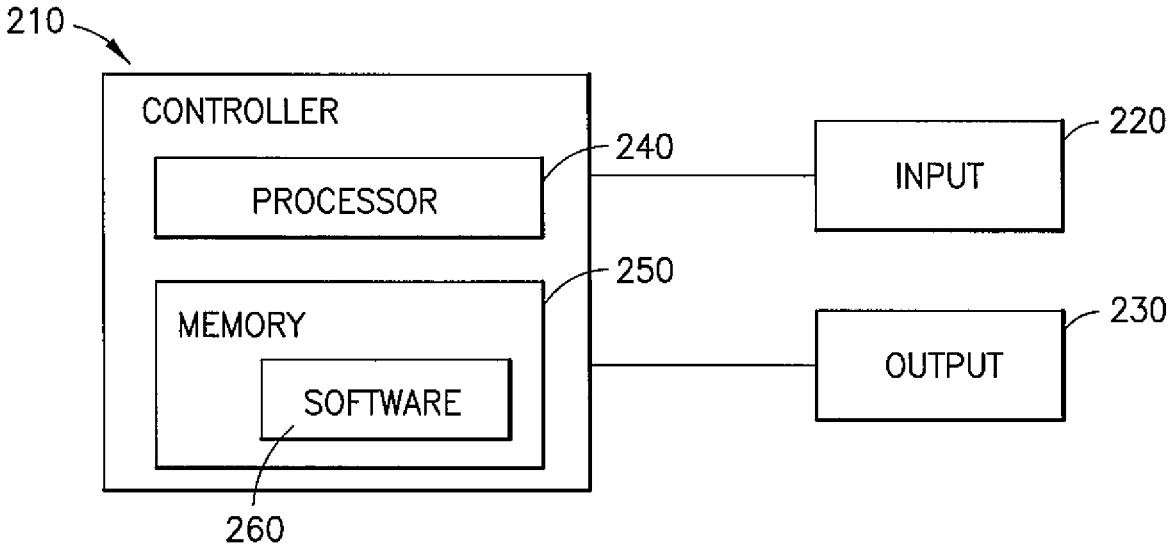
FIG. 2 is a diagram illustrating some components of the system shown in FIG. 1.

Referring also to FIG. 2, the reality system 100 generally comprises one or more controllers 210, one or more inputs 220 and one or more outputs 230. The input(s) 220 may comprise, for example, location sensors of the relative location system 130 and the smooth overlapping audio object rendering system 140, rendering information for a spatial audio rendering point extension from the smooth overlapping audio object rendering system 140, reality information from another device, such as over the Internet for example, or any other suitable device for inputting information into the system 100. The output(s) 230 may comprise, for example, a display on a VR headset of the visual system 110, speakers of the audio system 120, and a communications output to communication information to another device. The controller(s) 210 may comprise one or more processors 240 and one or more memory 250 having software 260 (or machine-readable instructions).

Figure 3A:
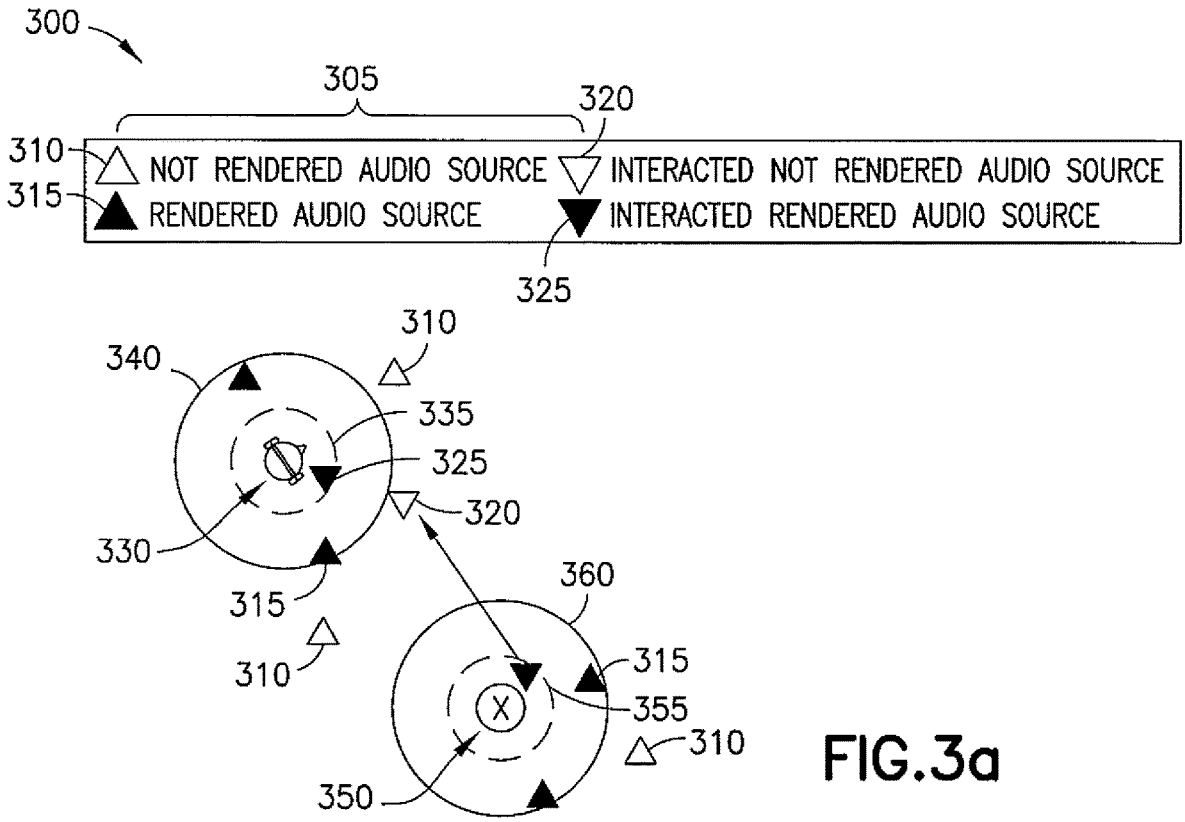
FIGS. 3*a* and 3*b* are diagrams illustrating proxy-based audio-object interaction causing a conflict with a user rendering position.
Figure 3B:
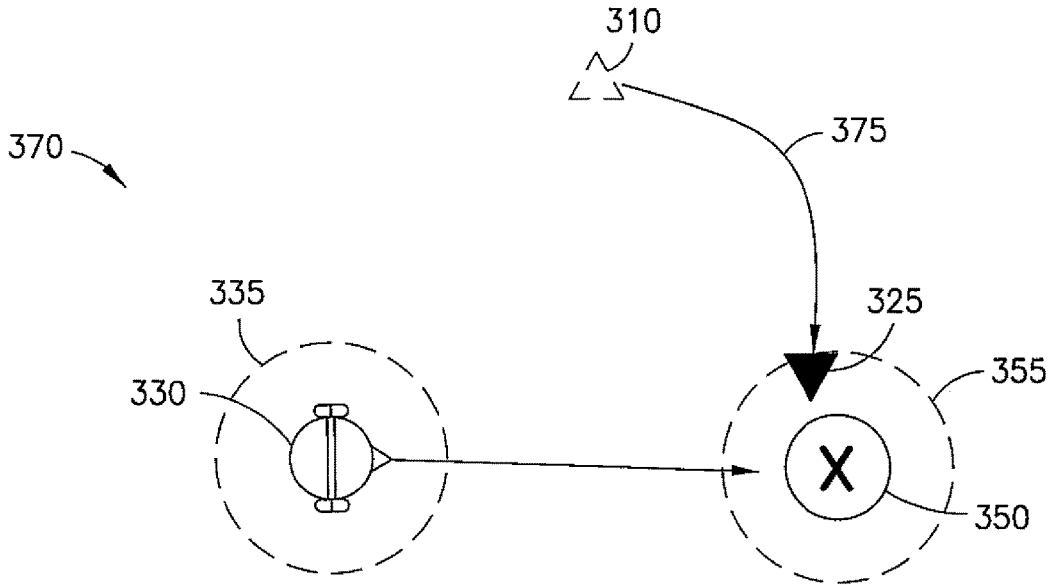

Referring also to FIGS. 3*a* and 3*b*, diagrams 300 and 370 illustrating proxy-based audio-object interaction causing a conflict with a user rendering position in which, for FIG. 3*a*, a spatial audio rendering point extension 350 is defined based on the user's position and, for FIG. 3*b*, the spatial audio rendering point extension 350 is independent of the user's position, are shown. A corresponding key 305 that illustrates different states of audio objects with respect to the renderings is also shown.

Audio object key 305 illustrates different states associated with audio sources based on a shape and a shading of each symbol. As seen in audio object key 305, a not rendered audio source 310, which represents audio sources that are not being rendered (or not perceived) at the user's current location, is represented by an unshaded triangle, a rendered audio source 315, which represents audio sources that are currently being rendered (by either the (audio rendering associated with) user 330 or the spatial audio rendering point extension 350), and which are likely being perceived by the user 330, is represented by a shaded triangle, an interacted not rendered audio source 320, which represents audio sources that are under interaction and not being rendered is represented by an inverted unshaded triangle, and an interacted rendered audio source 325, which represents audio sources that are under interaction and being rendered (by either the user 330 or the spatial audio rendering point extension 350), and likely being perceived, is represented by an inverted shaded triangle.

FIG. 3*a* illustrates an instance in which a user 330 utilizes a spatial audio rendering point extension 350 with at least one extension point that is defined relative to another point in the space. In this instance, the at least one extension point is defined relative to the user's listening position 330, and thus the at least one extension point moves similarly to the user's listening position 330. The movement of the at least one extension point (listening point movement) 350 may trigger a proxy-based audio-object interaction. In these instances, the interaction may cause the audio object (audio source 325) to move away from the at least one extension point, and the audio object may become audible (audio source 325) at the user's actual listening point. Furthermore, a new audio-object interaction may be triggered while the previously triggered interaction may still be in effect. There may be multiple possible outcomes for the rendering based on the audio-object interaction in instances in which the smooth rendering process is not applied.

FIG. 3*b* illustrates an instance in which the spatial audio rendering point extension 350 is defined independent of the user's position. The at least one extension point may be a static point or relative to something else than the user's listening position 330. In these instances, the distance between the user and the at least one extension point is not fixed. The user 330 may therefore enter the rendering point extension area 355. In instances in which, for example, a moving 375 audio object 310 may first come in contact with the spatial audio rendering point extension 350 and therefore trigger a proxy-based audio-object interaction. Similarly to FIG. 3*a*, the two renderings may overlap in an undefined manner. In this instance, the audio-object may remain under the proxy-based interaction when the interaction with the user begins. This scenario may reduce the amount of control and certainty for the entity that directs (for example, provides instructions) the rendering (for example, a content creator). This may affect the ability to control the way content may be perceived by the user.

In some instances, switching between the rendering locations and settings corresponding to the at least one spatial rendering point extension and the default user rendering point may result in spatial and/or temporal discontinuity of the rendered audio (which may therefore appear unnatural and/or disturbing). In addition, the audio rendering may not correspond to the visual representation of an audio-visual content.

There may be more than one expected rendering for a single audio object in some instances, such as these, which may result in rendering issues in addition to those associated with the interaction aspect. The at least two expected renderings may differ in various ways. For example, the two renderings may differ in location and the playback time. In addition, the two renderings may differ in various effects relating to audio object size, directivity, audio (waveform) filterings, etc. Smooth overlapping audio object rendering system 140 may process the renderings to provide (present)

the user a natural (and pleasant/smooth transition) well-defined rendering, which does not suffer from unexpected discontinuities or artefacts.

Figure 4:
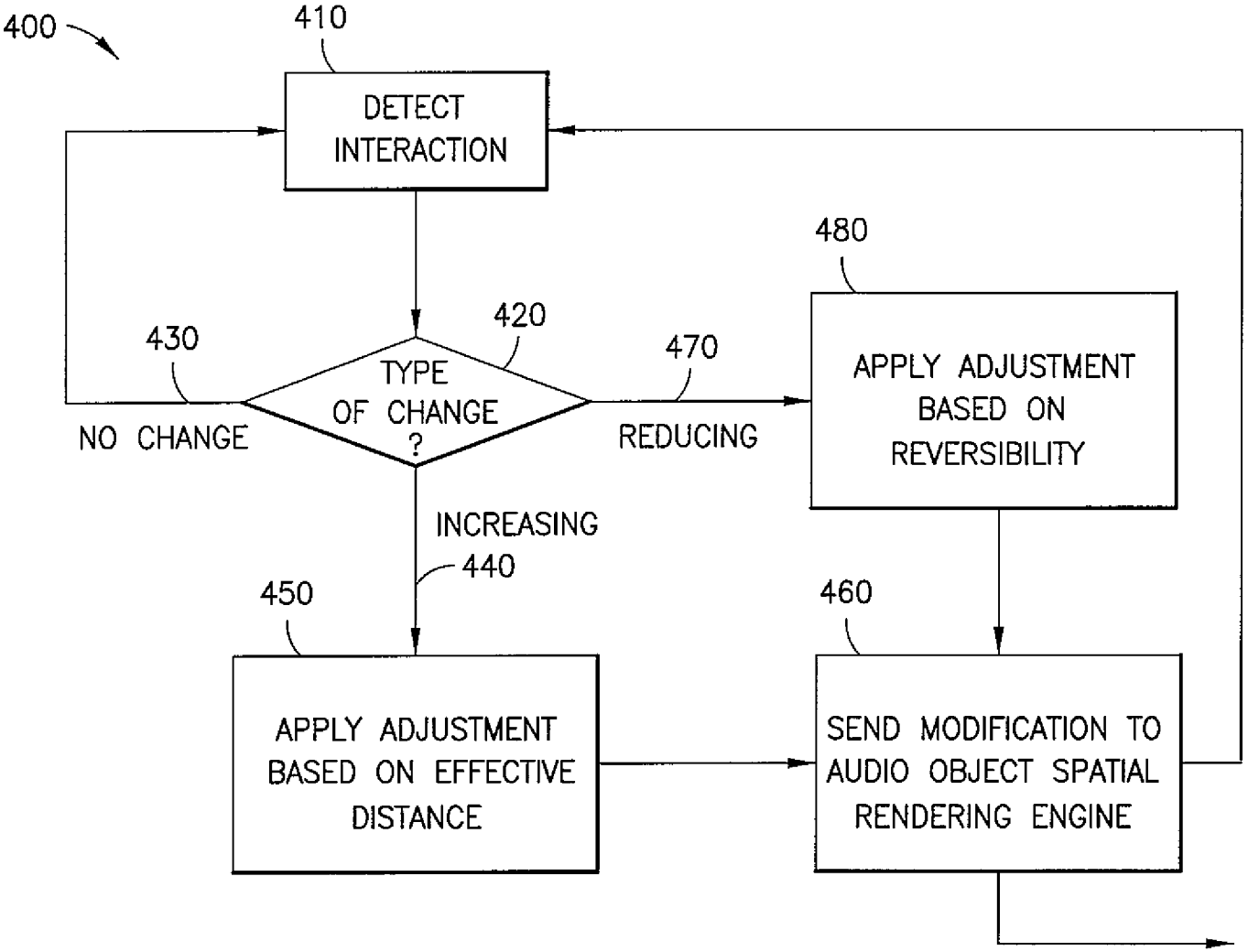
FIG. 4 illustrates an example process of interaction detection and parameter modification decision based on change of interaction.

Referring also to FIG. 4, there is shown a flowchart of a method that includes processes similar to those described in U.S. patent application Ser. No. 15/293,607.

As shown in FIG. 4, the system 100 may detect an interaction 410 and determine a type of change 420 to be implemented based on the interaction. If there is no change 430, the system 100 may return to detecting interaction 430. If there is an increase 440 or a reduction 470, the system may control the effect of an audio-object interaction via parameters that define the strength or depth of the interaction with the audio object, such as, for example, effective distance 450 (in response to an increase 440) and reversibility parameters 480 (in response to a decrease/reduction 470) and thereafter send the modification information to an audio object spatial rendering engine 460. The system 100 may analyze how the audio object responds to an interaction that is increasing or one that is decreasing in its strength or depth to determine an optimal response (for example, a natural or smooth response) to the interaction.

The system 100 may determine that there are at least two processes that may attempt to control the audio-object interaction simultaneously (for example, such as described with respect to FIGS. 3*a* and 3*b*). Each of the at least two processes may be configured to implement an audio rendering process, such as illustrated in FIG. 4. The system 100 may therefore apply a process, via smooth overlapping audio object rendering system 140, to ensure that only one rendition of each audio object is determined (and to prevent duplicates or multiples of the audio object). Smooth overlapping audio object rendering system 140 may apply processes to determine instances in which to prevent an interpolation. An interpolation may, in some instances, create effects (for example, audio objects or artefacts) that, although stable, do not correspond to the scene (and, further, some characteristics such as time difference in playback may not allow in the interpolation to be implemented in a stable or smooth manner). Smooth overlapping audio object rendering system 140 may apply processes to prevent discontinuities (and/or disturbances) based on switching from one audio rendering of an audio object to the other.

Although FIG. 4 describes a particular example of a framework for audio-object interaction, it should be understood that there may be other types of audio-object interactions. Smooth overlapping audio object rendering system 140 may apply processes to smooth rendering of overlapping audio object interactions based on other types of frameworks for audio-object interactions.

Smooth overlapping audio object rendering system 140 may apply processes to smooth rendering of overlapping audio object interactions in scenarios, such as scenario one, in which one instance of an audio object with at least two simultaneous renderings is to be fused into a single rendering without discontinuities or artefacts. For example, in instances such as described in U.S. patent application Ser. No. 15/412,561, filed Jan. 23, 2017, a single audio-object instance may, due to spatial audio rendering point extension 350, result in at least two different base renderings of an audio object that smooth overlapping audio object rendering system 140 may fuse into a single rendering for the user.

Smooth overlapping audio object rendering system 140 may process the audio renderings to result in providing a single audio-object rendering to the user which remains stable throughout playback.

Figure 5A:
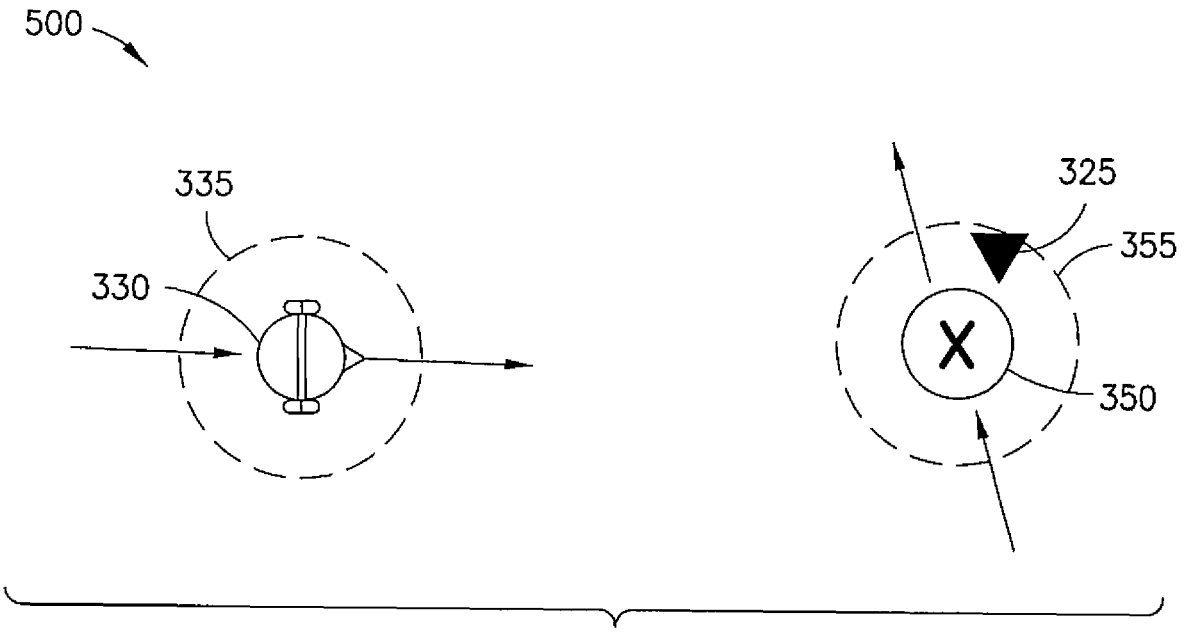
FIGS. 5*a* and 5*b* are example illustration of a proxy-based audio-object interaction causing a conflict with the user rendering position for a scenario in which a single audio object may have multiple instances.
Figure 5B:
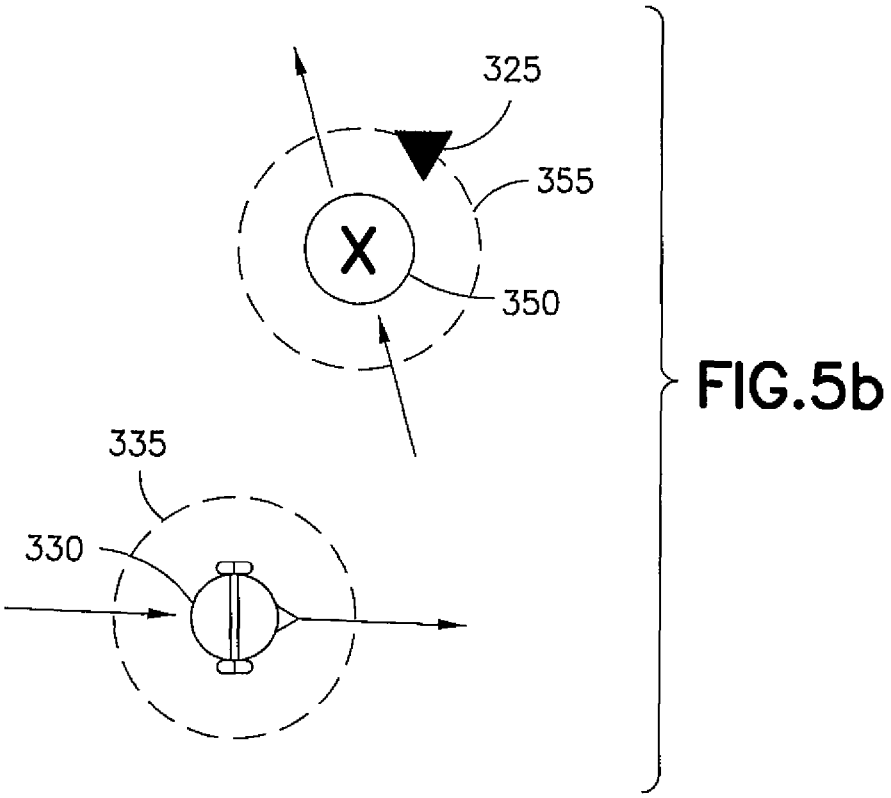

FIGS. 5*a* and 5*b* are example illustrations 500 of a proxy-based audio-object interaction causing a conflict with the user rendering position for a scenario in which a single audio object may have multiple instances.

As shown in FIGS. 5*a* and 5*b*, a proxy-based audio-object interaction may cause a conflict with the user rendering position for a scenario, such as scenario two, in which a single audio object may have multiple instances. In this scenario, smooth overlapping audio object rendering system 140 may fuse at least two instances of one audio object that both have at least one rendering into a single rendering without discontinuities or artefacts. This scenario may increase (in some instances, drastically) the probability of an overlapping interaction, as the user may come in contact with at least one instance of an audio object that is already under an interaction and a corresponding original instance of the audio object (shown as audio object 310 in FIG. 5*b*).

To provide a well-defined and pleasant playback experience, smooth overlapping audio object rendering system 140 may control the overlapping audio-object interaction. Smooth overlapping audio object rendering system 140 may process interactions such as those illustrated in FIGS. 5*a* and 5*b*. The user 330, as shown in FIG. 5*a*, may move towards a location associated with a spatial audio rendering point extension 350. This scenario may lead to creation of at least a second instance of the audio object in FIG. 5*b* where, for example, the original instance of the audio object 310 remains in its original location and state, while the at least second instance of the audio object 325 provides the rendering for the at least one interaction (based on being within a rendering area 355 associated with the spatial audio rendering point extension 350).

Smooth overlapping audio object rendering system 140 may process the two separate renderings to either smoothly mute one of the renderings while keeping the other audible or smoothly move and fuse into one rendering.

Figure 6:
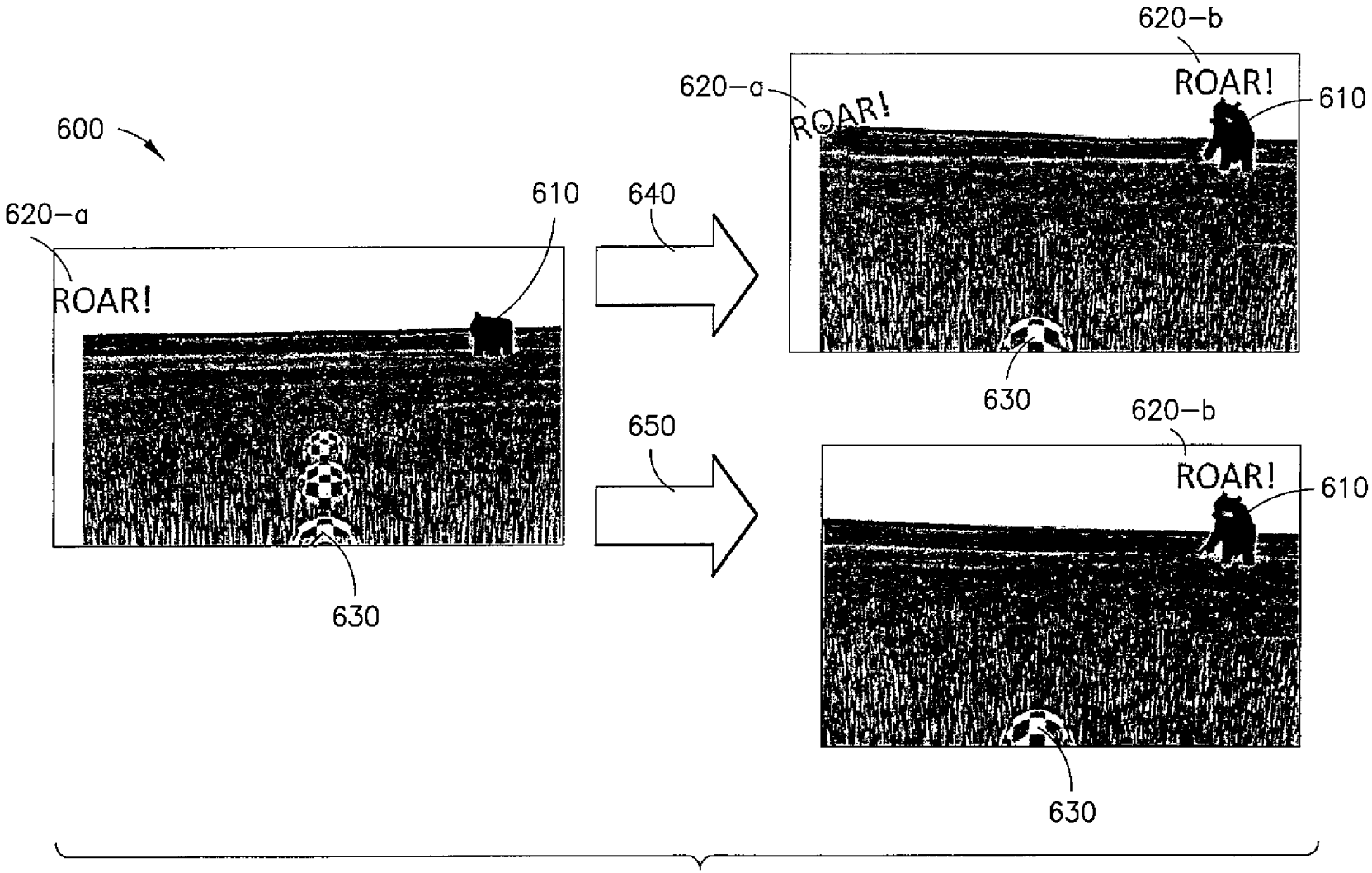
FIG. 6 is an example illustration of multiple possible changes to a rendering as a user moves to a new rendering location in a free-viewpoint audio experience.
Figure 7:
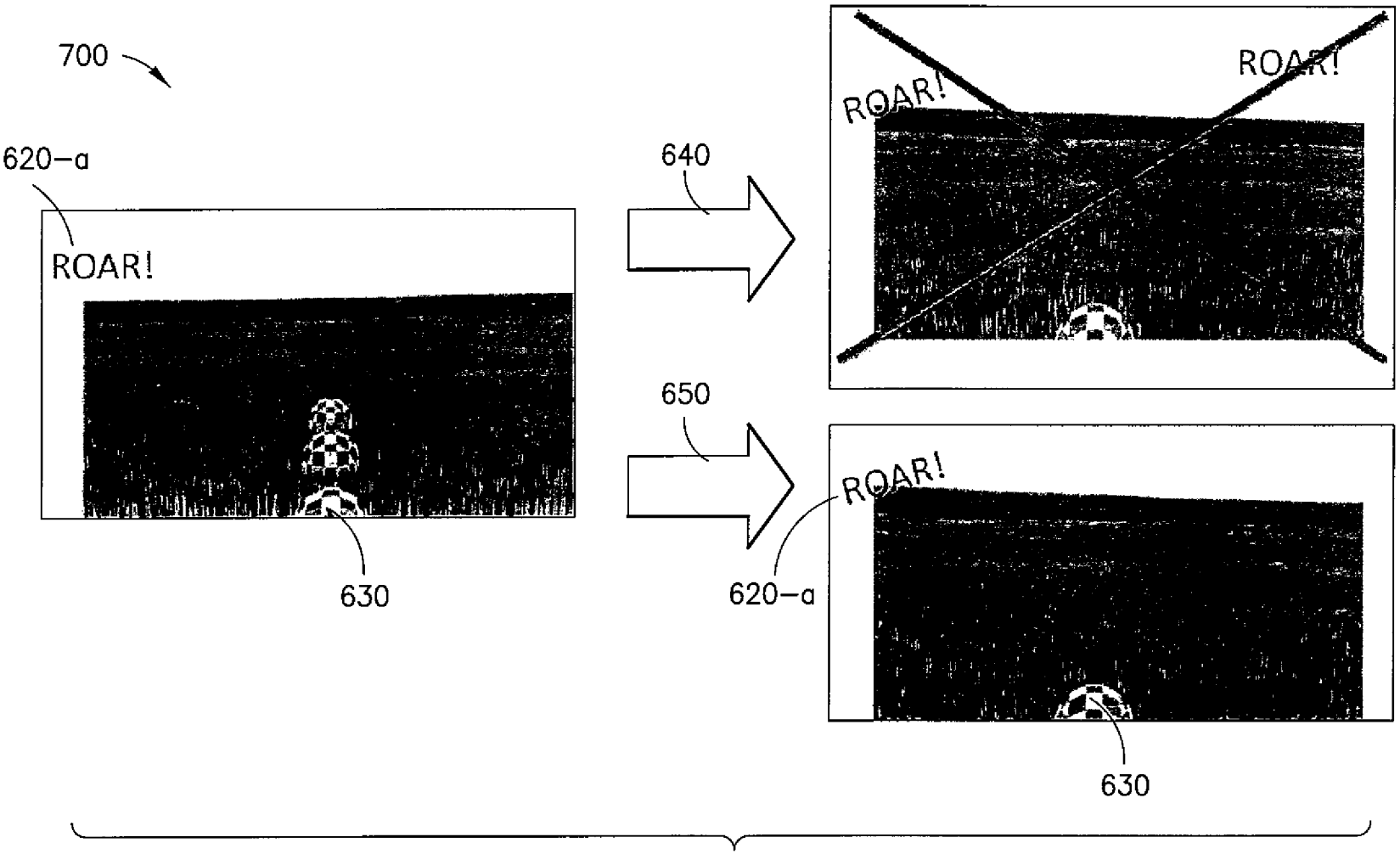
FIG. 7 is a comparative illustration (against FIG. 6) of the way a rendering may change as a user moves to a new rendering location in a free-viewpoint audio experience.

Referring also to FIGS. 6 and 7, illustrations of a free-viewpoint audio experience rendering where a user moves from a first location to a new location are shown. On the left-hand side of both FIGS. 6 and 7, an illustration of a rendering at a first location is shown, while on the right-hand side of both FIGS. 6 and 7, illustrations of alternative renderings at a new location are shown.

Referring in particular to FIG. 6, an example illustration 600 of multiple possible changes to a rendering as a user moves to a new rendering location in a free-viewpoint audio experience is shown. The illustration includes a bear 610 on a field, where the audio object 620-*a* associated with the bear 620 has previously been interacted with through a spatial audio rendering point extension 350. The scenario illustrated in FIG. 6 corresponds to the scenario described above in which there are two instances of the audio object associated with a single audio source (for example, the bear). As the user moves closer to the audio source, the original audio object 620-*b* associated with the bear 610 (audio source) may be triggered. The right side of FIG. 6 illustrates two ways a rendering may change (640 and 650) as a user moves to a new rendering location in a free-viewpoint audio experience. This may generate two instances of a single audio object (620-*a* and 620-*b*) associated with an audio source or object (the bear 610).

System 100 and smooth overlapping audio object rendering system 140 may process the scene and the audio renderings to compensate for effects of an ongoing interaction and to prevent multiple instances of a single object or audio source being rendered to the user (for example, two audio objects 620-*a* and 620-*b* associated with the bear 610).

Visually, system 100 may be configured to select the rendering on bottom right (650) as this is a more logical and realistic portrayal and, for example, the second instance of the audio object 620-*a* may be muted and only the original audio object instance 620-*b* may be rendered to the user.

FIG. 7 is a comparative illustration 700 (against FIG. 6) of the way a rendering may change as a user moves to a new rendering location in a free-viewpoint audio experience.

As shown in FIG. 7, a scenario, such as scenario one described hereinabove with respect to FIG. 4, in which one instance of an audio object with at least two simultaneous renderings may be fused into a single rendering without discontinuities or artefacts, is shown. Smooth overlapping audio object rendering system 140 may process the audio renderings to result in providing a single audio-object rendering. In this instance, there is no inherent duplication of the audio object, and the original audio object may have moved according to the interaction using the spatial audio rendering point extension 350. As the user 630 moves closer to the position of the original audio object location, the rendering on top right 640 may be excluded. Instead, smooth overlapping audio object rendering system 140 may determine a rendering such as shown on bottom right 650, which may include expected corresponding visual elements.

Note that the resulting rendering of FIG. 7 (650) differs from the illustration in FIG. 6, which describes a scenario in which multiple (at least two) instances of an audio object may be rendered. Further, smooth overlapping audio object rendering system 140 may determine a rendering (for example, a free-viewpoint audio experience) that may be audio-only. As shown in FIGS. 6 and 7, mismatches may arise between different scenarios for overlapping audio-object interaction and the expected renderings. A different response may be desired, for example, in applications that are audio-visual and those that are audio-only experiences. The audio should correspond to the visual stimuli in the former, while it is not required for the latter type of applications.

In some instances, there may be scenarios (or use cases) in which audio objects are explicitly duplicated. In these instances, smooth overlapping audio object rendering system 140 may determine a rendering such as in the top right panel of FIG. 6 (640). In this instance, smooth overlapping audio object rendering system 140 may decline to apply any new modification and the individual audio object instances may be processed, such as described with respect to FIG. 4. This process may be controlled, for example, through metadata inputs that determine the adjustments, etc.

Figure 8B:
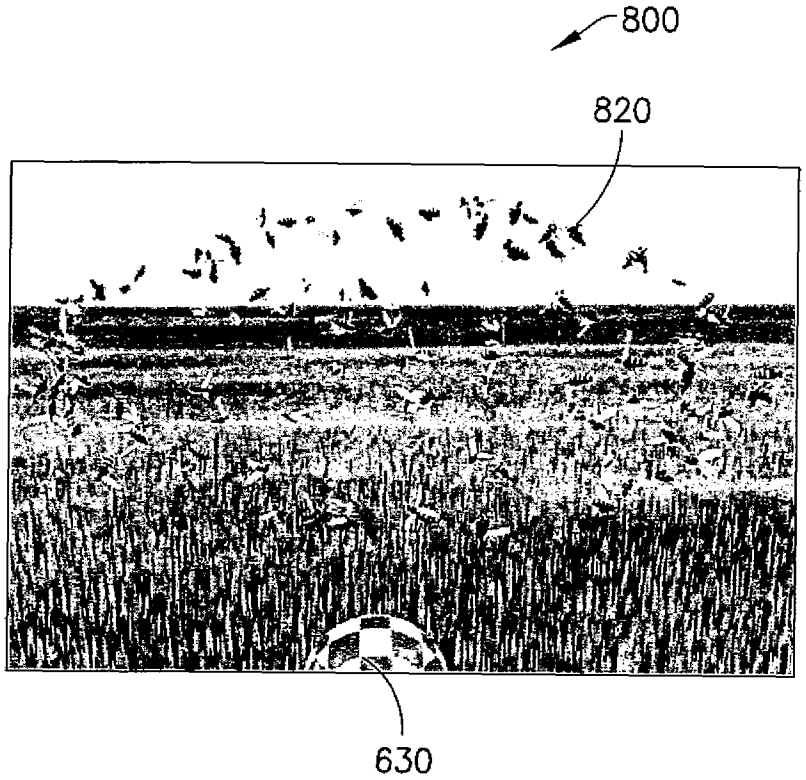
FIGS. 8*a* and 8*b* are diagrams illustrating an audio object in a regular stage (8*a*) and under interaction (8*b*)
Figure 8A:
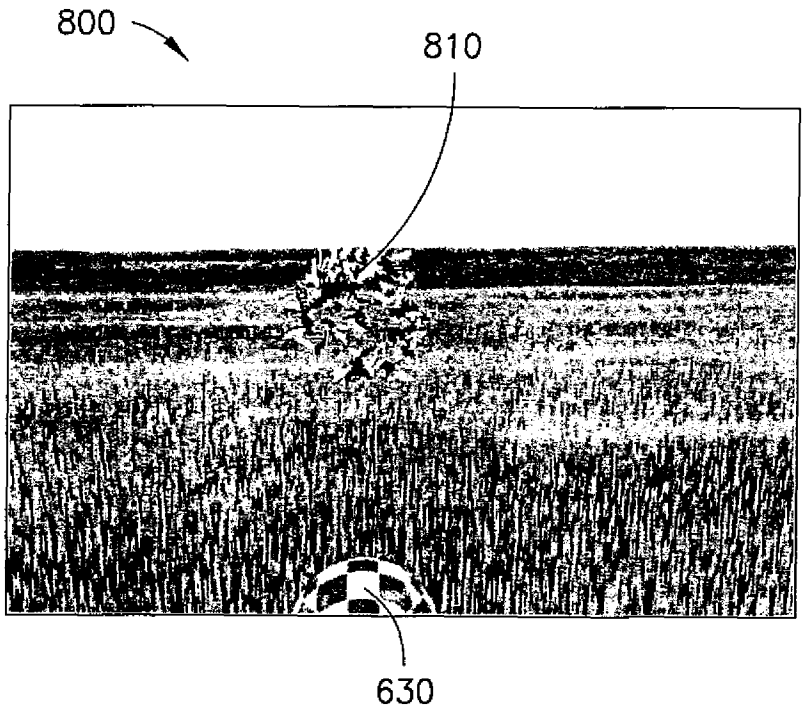

FIGS. 8*a* and 8*b* are diagrams 800 illustrating an audio object in a regular stage (8*a*) (prior to interaction) and under interaction (8*b*).

Smooth overlapping audio object rendering system 140 may be configured to determine a single (fused) audio-object rendering for the user both in instances, such as scenario one, in which one instance of an audio object with at least two simultaneous renderings may be fused into a single rendering, and scenario two, in which at least two instances of one audio object both with at least one rendering may be fused into a single rendering without discontinuities or artefacts. As shown in FIG. 8*a*, the first stage corresponds to an audio object 810 that is not interacted with. The second stage corresponds to an audio object that is under an interaction 820. In this example, we see a swarm of bees flying. During an interaction, such as the user 630 entering the swarm, the audio object rendering may be changed considerably (from 810 to 820). For example, an audio object widening is performed here. This may result in a change (for example, a more heavily externalized "auditory view") in the audio object (for example, the swarm of bees) for the listener who enters the swarm location.

The visualization illustrated with respect to FIG. 8*b* may correspond to the user remaining inside of a larger swarm despite considerable head movements (and even stepping back and forth). Prior to the interaction illustrated in FIG. 8*b*, the user would experience the audio object (according to FIG. 8*a*) as a very localized sound which may (for example, one point) appear to be emitted, for example, from the left-hand side of the user, then the right-hand side of the user, and then from the inside of the user's head based on (even fairly slight) head or body movements by the user. The changes in the sound source direction (for example, pumping, oscillations, etc.) may be very disturbing and disorienting for the user.

Referring back to FIGS. 3*a* and 3*b*, the audio rendering may first be presented to the user as an ongoing interaction via a proxy (FIG. 3*a*) that may then proceed to include a second interaction based on the actual user position. Smooth overlapping audio object rendering system 140 may determine this rendering change as a smooth interpolation, or a handover resulting in a single rendering at the overlap, depending on the content and the use case context. Although one interaction may be stronger than another one, and one may end and start again while the second one is ongoing, smooth overlapping audio object rendering system 140 may maintain the rendering in a pleasant (for example, increasing the positional stability and/or the consistency of the volume level, reducing abrupt changes and/or oscillation between renderings, etc.) and consistent manner for the user.

Smooth overlapping audio object rendering system 140 may thereby prevent the system 100 from situations of competing possible renderings in which the overall change in the rendering is undefined, such as those that may be defined by FIG. 4. For example, smooth overlapping audio object rendering system 140 may reduce or eliminate an oscillation between two different interaction stages (which may be highly irritating), such as, for example, between interaction stages of FIGS. 8*a* and 8*b*.

Figure 9:
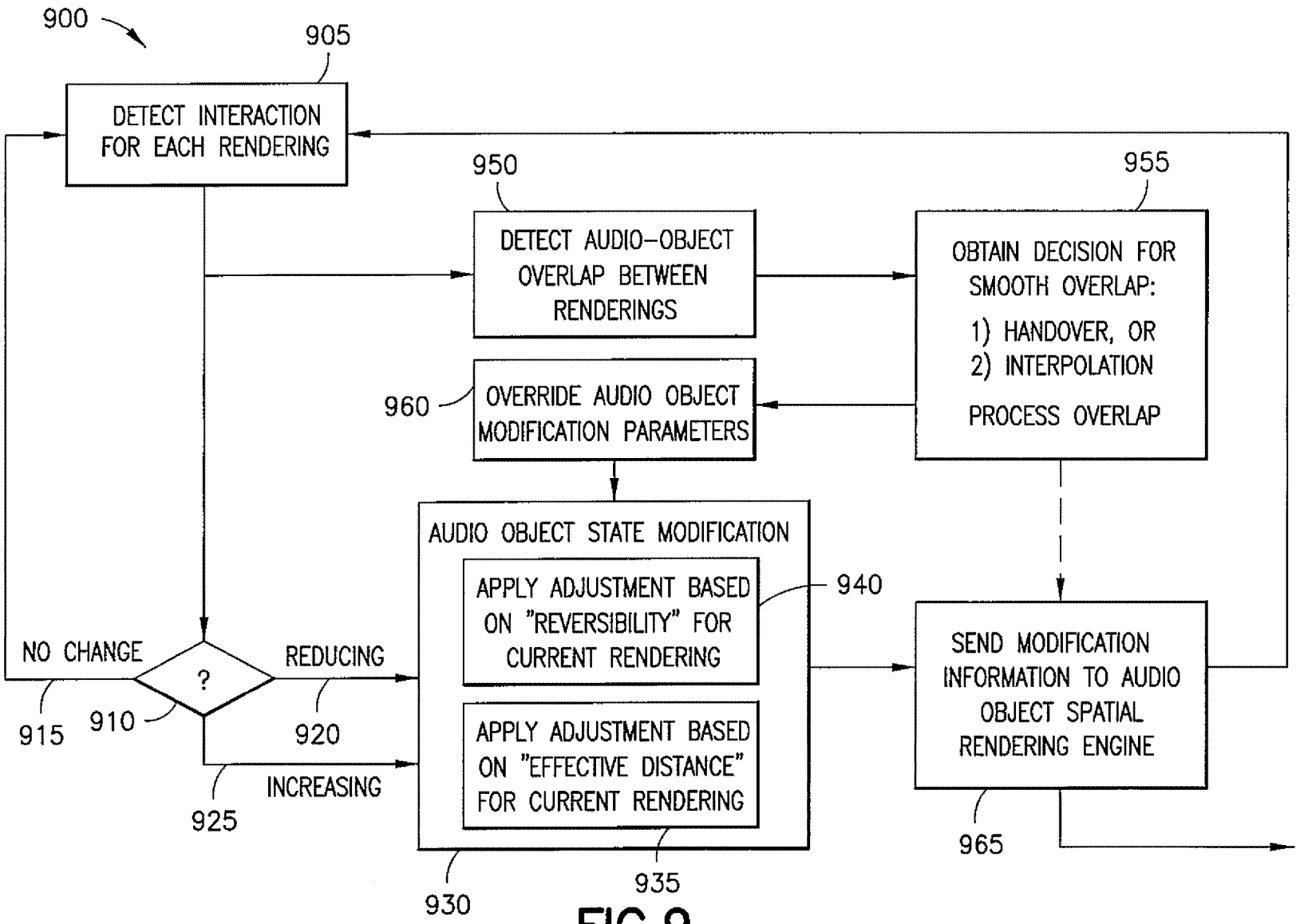
FIG. 9 is a diagram illustrating a process for detecting an interaction overlap.

Referring now to FIG. 9, a diagram illustrating a process 900 for detecting an interaction overlap is shown.

Process 900 may include similar steps to those described with respect to FIG. 4 hereinabove, and/or those that are described with respect to U.S. patent application Ser. No. 15/412,561. In addition, process 900 may include steps for detecting an audio-object interaction overlap. Although process 900 is in some instances described with respect to FIG. 4, it should be understood that the processes and methods may be applied to other audio-object interaction systems.

Steps for audio-object adjustments related to audio-object interactions (such as adjustments based on reversibility 940 or effective distance 935) are provided in FIG. 9 as examples of audio-object state modifications. However, smooth overlapping audio object rendering system 140 may also be utilized in a system that processes different types of audio-object interactions than those discussed in U.S. patent application Ser. No. 15/412,561 and U.S. patent application Ser. No. 15/293,607. Smooth overlapping audio object rendering system 140 may analyze each rendering separately and in parallel. Each rendering in this scenario may include each instance of each audio object that may be rendered at each rendering location derived, for example, based on user location and/or at least one spatial rendering extension. Smooth overlapping audio object rendering system 140 may be configured to process both scenarios of FIGS. 3*a* and 3*b* and FIGS. 5*a* and 5*b*.

Process 900 may include steps similar to those described with respect to process 400 hereinabove. These may include detection of interaction for each rendering 905, determination of a type of change based on the audio-object interaction 910, and processes based on the type of change. These may include repeating the detection process 905 in instances in which there is no change 915, and audio object state modification 930 in response to changes that either reduce 920 or increase 925 the audio object interaction. Audio object state modification 930 may include applying an adjustment based on reversibility of the current rendering 940 or based on effective distance 935.

At block 950, smooth overlapping audio object rendering system 140 may detect (at least one) audio-object overlap between at least two renderings. In other words, smooth overlapping audio object rendering system 140 may detect whether at least two renderings (user location and a spatial audio extension) contain the same audio object. In some embodiments, smooth overlapping audio object rendering system 140 may also predict that such a detection may take place at a future time and incorporate this information into a rendering decision. This may be based, for example, on the user's movement vector as well as audio object movement. However, smooth overlapping audio object rendering system 140 may process the at least two renderings without directly analyzing a prediction of future movement of the user and/or audio object.

At block 955, smooth overlapping audio object rendering system 140 may make a decision on (or determine which) the type of overlap processing that will be performed, and subsequently perform said processing.

Block 955 may include a decision on the overlap smoothing and application of processing/adjustments. Smooth overlapping audio object rendering system 140 may implement at least two processes to smooth the overlap depending on the overlap and interaction characteristics. One is a handover and the other is an interpolation. A handover may occur when one of the at least two renderings is selected as the main renderings (and smooth overlapping audio object rendering system 140 may ramp down the at least second one, which the user may hear). Smooth overlapping audio object rendering system 140 may determine that a handover is to be implemented when the location state or a 'location' parameter resulting in a state change of each overlapping rendering is significantly different.

Smooth overlapping audio object rendering system 140 may also determine that a handover is to be implemented when a playback time state or a 'time shift' parameter resulting in a state change of each overlapping rendering is significantly different. Playback time state refers to the 'sample' or 'time code' of the audio track, for example, the time at which the audio object is to be played. For example, an audio object interaction may result in rewinding an audio track to a specific time instant or sample. There will be a metadata parameter value that says so. There may also be, e.g., a switch of an audio track in case of an audio object interaction. Again, another metadata parameter would define this.

Figure 10:
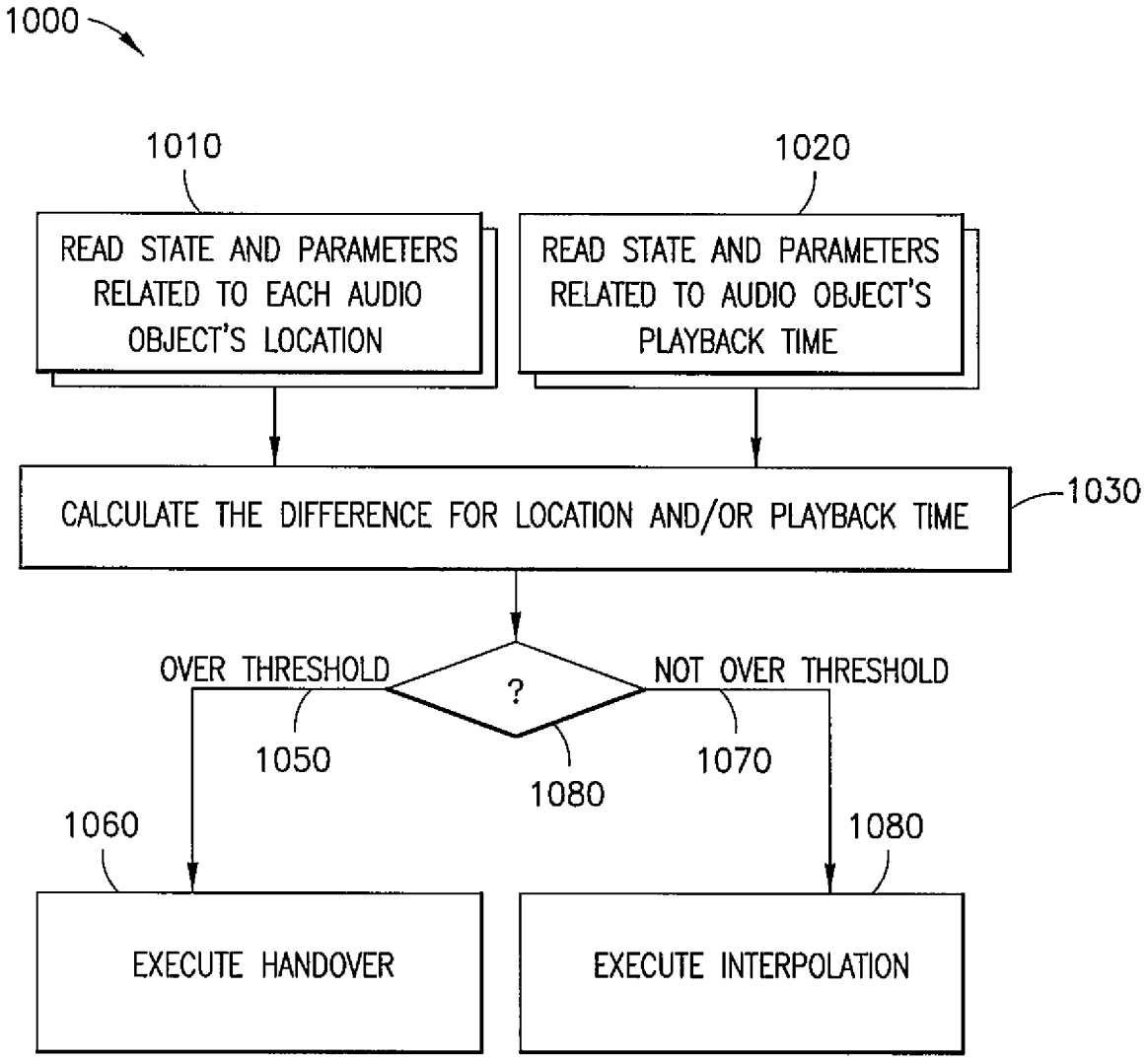
FIG. 10 is a diagram illustrating determination of a decision to select between a handover mode and an interpolation mode.

Smooth overlapping audio object rendering system 140 may determine an exception to the handover policy in instances of a significantly different playback time state or a 'time shift' parameter when a different playback is intended under each: a user interaction and an extension point interaction. In these instances, smooth overlapping audio object rendering system 140 may also implement an interpolation, for example, based on instructions provided by the implementer and/or content creator. Smooth overlapping audio object rendering system 140 may consider (or analyze) 'location' and 'time shift' parameters and the corresponding states when deciding on a handover. The analysis may check whether the time instants are the same, as smooth overlapping audio object rendering system 140 may generally limit (or disallow) interpolation between two audios that do not match in time. Thus smooth overlapping audio object rendering system 140 may include information regarding both the current playback time and any parameter that controls the playback time (such as a parameter that instructs for the playback time to be reset) in the analysis. If handover is not selected, smooth overlapping audio object rendering system 140 may implement an interpolation approach. FIG. 10 below presents an illustration of the selection.

According to an example embodiment, smooth overlapping audio object rendering system 140 may first determine whether an interpolation is to be applied and if/when such interpolation should not be used, the smooth overlapping audio object rendering system 140 may apply a handover as an alternative process. The smooth overlapping audio object rendering system 140 may (generally) select to not perform an interpolation when the location of the at least two audio object renderings is very different (and interpolation may create a location discontinuity that may sound disturbing and, in the case of audio-visual objects, may not agree with the visual percept) or when they have a significantly different playback time instant (for example, the conflicting renderings would interpolate a song at two different time instants, for example, time instant 0:15 min and 3:12 min, into a single waveform).

At block 960, smooth overlapping audio object rendering system 140 may override the audio-object state modification that is based on each separate interaction. The replaced values may be stored, for example, to take into account the chance that the overlap condition may be lifted at a future time.

In some embodiments, at block 965, the overlap detection information or associated metadata (such as the handover or interpolation information) may be sent to an audio-object spatial rendering engine 946.

FIG. 10 is a diagram illustrating determination of a decision to select between a handover mode and an interpolation mode.

Smooth overlapping audio object rendering system 140 may implement processes, such as described with respect to FIGS. 9 and 10. Smooth overlapping audio object rendering system 140 may detect an overlap of audio-object interactions between individual renderings, obtain the most important difference in the associated renderings, and based on the most important difference either interpolate between the at least two renderings or force the renderings to fuse into a single rendering to provide the user with a clear and consistent user experience.

At block 1010, smooth overlapping audio object rendering system 140 may read state and parameters related to an audio object's location for at least two renderings.

At block 1020, smooth overlapping audio object rendering system 140 may read state and parameters related to an audio object's playback time for the at least two renderings.

At block 1030, smooth overlapping audio object rendering system 140 may calculate a difference in parameters for location and/or playback time and make a determination whether the parameters are over a predetermined threshold at block 1040. In some instances, the playback time threshold may be zero, for example, no change may be allowed. In other example embodiments, other (non-zero) thresholds may be applied based on particular features of the renderings, etc.

For decision-related differences there may be a threshold value. The threshold value does not have to be a fixed value. For the interpolation-related (and, in some instances, handover-related) differences there may be instances in which there is no threshold. For decision-related differences, smooth overlapping audio object rendering system 140 may decide to use either interpolation or execute the handover based on a threshold or similar mechanism to make the decision on the mode. For example, some differences, such as at least the location and playback time, may not work well for interpolation as an average of the two times may be not be useful as a target for the modified rendering. In these instances, smooth overlapping audio object rendering system 140 may decide between interpolation mode and handover mode based on the difference. Other differences, such as a volume level between two volumes for the at least two renderings for interpolation mode, may not require a threshold. In interpolation mode, smooth overlapping audio object rendering system 140 may select a volume level in between the two volume levels for the renderings. In instances in which smooth overlapping audio object rendering system 140 is in a handover mode, smooth overlapping audio object rendering system 140 may select one of the volume levels.

In instances in which the difference is over a predetermined threshold, at block 1050, smooth overlapping audio object rendering system 140 may make a decision or determination to execute a handover at block 1060.

In instances in which the difference is under the predetermined threshold, at block 1070, smooth overlapping audio object rendering system 140 may make a decision or determination to execute interpolation at block 1080.

Smooth overlapping audio object rendering system 140 may implement interpolations to balance aspects of all of the at least two overlapping interactions while maintaining a stable overall rendering. On the other hand, smooth overlapping audio object rendering system 140 may implement handovers to avoid disruptions and discontinuities where an interpolation provides an unwanted user experience. In instances in which disruption in the experience cannot be avoided, smooth overlapping audio object rendering system 140 may implement the handover as smooth as possible.

Once a handover mode is triggered for an overlap, smooth overlapping audio object rendering system 140 may, in some instances, restrict switching back to interpolation mode (for example, because the switching is the target of the handover processing). However, in some instances, smooth overlapping audio object rendering system 140 may switch from an interpolation mode to the handover mode based on various requirements or instructions provided to smooth overlapping audio object rendering system 140. Smooth overlapping audio object rendering system 140 may implement the restriction on switching back based on how the handover modifies the audio-object states and interaction parameter as described below.

In particular example embodiments, smooth overlapping audio object rendering system 140 may implement the handover to adapt the first interaction (which may be referred to as a main interaction) and reset the at least second interaction. Thus, as the at least second interaction will be reset, a switch back to the interpolation mode (which requires at least two interactions to interpolate between) may not be possible. In some embodiments, smooth overlapping audio object rendering system 140 may implement the handover in a way that appears to reset the at least second interaction without fully (or really) resetting the at least second interaction.

Figure 11B:
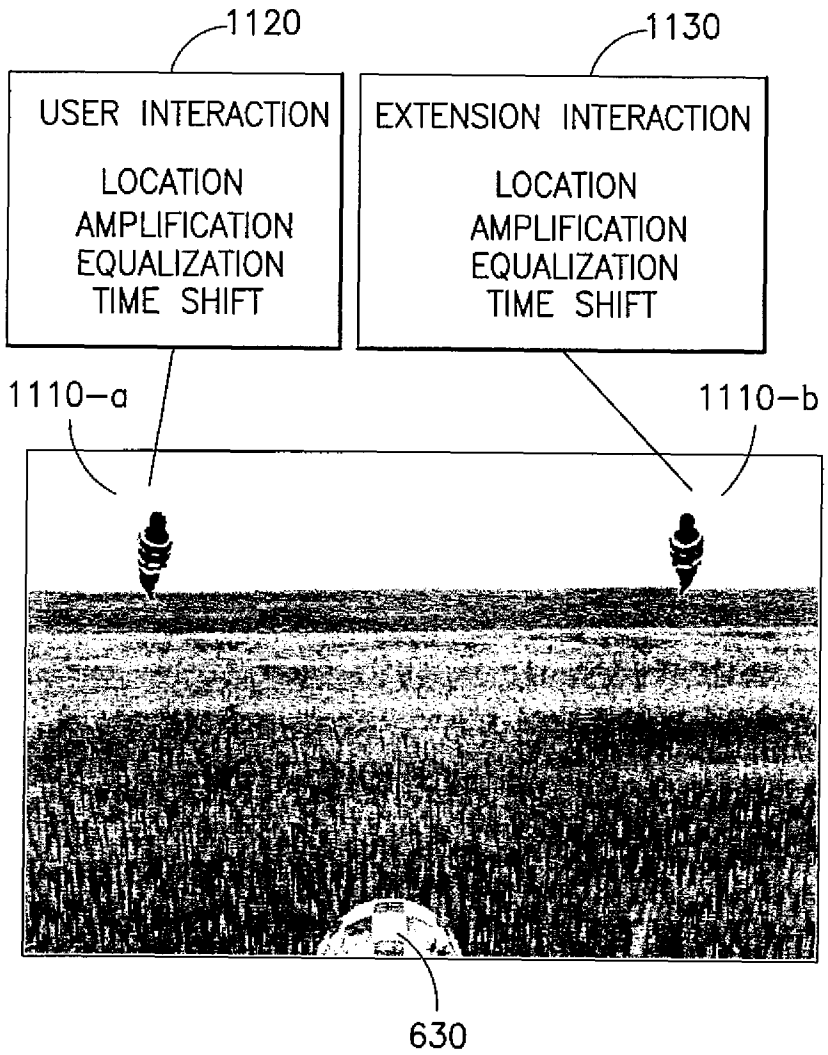
FIGS. 11*a* and 11*b* are diagrams illustrating (11*a*) audio object under two overlapping interactions and (11*b*) two audio-object instances under interaction each featuring an interaction parameter set.
Figure 11A:
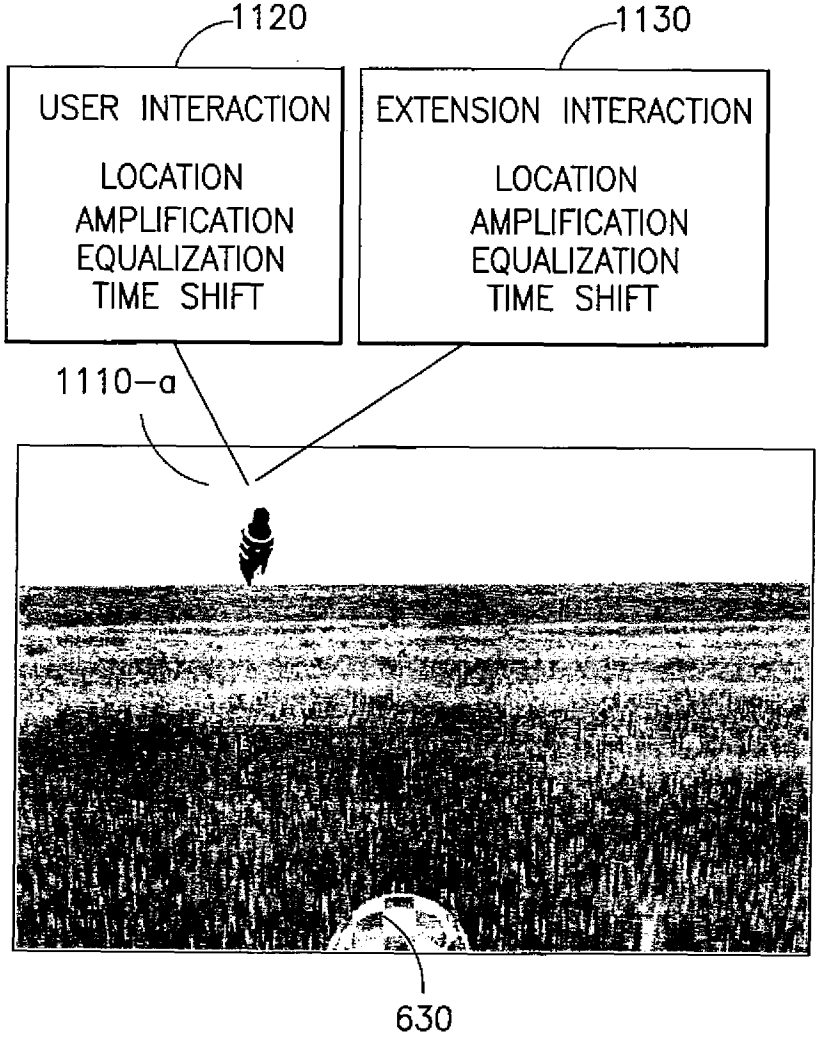

FIGS. 11*a* and 11*b* are diagrams illustrating (11*a*) audio object under two overlapping interactions and (11*b*) two audio-object instances under interaction each featuring an interaction parameter set.

FIG. 11*a* illustrates an audio object under two overlapping interactions with a set of interaction parameters for each of the two interactions. The interaction parameters for a user interaction 1120 include a location, an amplification, an equalization, and a time shift associated with the user, while the interaction parameters for the extension interaction include a location, an amplification, an equalization, and a time shift associated with the extension.

FIG. 11*b* illustrates two instances of an audio object under overlapping interactions each featuring a set of interaction parameters. In this instance, the experience may be audio only, for example, the user may not be presented with the illustrative views.

In both scenarios described with respect to FIGS. 11*a* and 11*b*, one interaction may correspond to the direct user interaction, while the second interaction may be via a spatial audio rendering extension point.

In FIG. 11*a*, there is a single audio-object instance at a first point in time and its (at least) two renderings may initially coincide in location. However, the two renderings may begin to deviate in instances in which only the method of FIG. 4 is applied to each of the renderings. In order to fuse the renderings (for example, to provide a single rendering for the user), smooth overlapping audio object rendering system 140 may apply process to smooth rendering of conflicting audio-object interactions, for example, as shown hereinabove (FIGS. 9 and 10).

As the initial locations illustrated in FIG. 11*a* are the same, the handover mode is initially dormant because there is no location difference to trigger the handover mode. However, the handover mode may be triggered by the location modification parameters (in conjunction with the two interaction triggers, the user and the spatial rendering point extension). With regard to playback time, the handover mode may not be activated due to playback time difference in instances in which the playback time for the at least two renderings are initially the same and remain the same. However, if the payback times are different, smooth overlapping audio object rendering system 140 may synchronize the at least two renderings in order to provide a consistent user experience. Smooth overlapping audio object rendering system 140 may thereby reduce or eliminate errors and rendering issues, such as, for example, having a person (an instance of the audio object) simultaneously speaking two separate passages of a single monologue.

Smooth overlapping audio object rendering system 140 may synchronize towards the user interaction values by default (for example, the user rendering and associated values may be set as the main rendering). Smooth overlapping audio object rendering system 140 may determine the synchronization to provide a single interaction and to prevent execution of one or more additional interactions according to the default interaction handling. This may be referred to as a handover. In a handover, the initial values may be smoothly interpolated to the parameter values given by the interaction to which smooth overlapping audio object rendering system 140 make the handover (for example, the user interaction in this example). After smooth overlapping audio object rendering system 140 performs the smooth interpolation process, the two renderings may have the same values, for example, the two renderings may correspond to the main rendering. Only one rendering may be rendered to the user and it may thereby correspond to the main rendering. Smooth overlapping audio object rendering system 140 may determine a duration of the smoothing based, for example, on metadata or on instructions provided by an administrator or implementer.

In some instances, metadata may allow for the playback time to be based on the proxy-based interaction instead of the user interaction, although the user interaction would remain the main rendering. For example, smooth overlapping audio object rendering system 140 may thereby avoid rewinding a monologue due to a new interaction. Smooth overlapping audio object rendering system 140 may modify other playback characteristics than the playback time.

In instances in which there is no difference in the location and the playback time between the renderings, smooth overlapping audio object rendering system 140 may remain in an interpolation mode. In these instances, smooth overlapping audio object rendering system 140 may combine the effect of the two interactions in the overall rendering to the user. For example, smooth overlapping audio object rendering system 140 may analyze one of the renderings that may provide a larger size for the sound source than the other, and perform the interpolation maintaining the size between these two values for the sound source. Metadata or, for example, use-case specific implementation, may specify how each parameter is interpolated and whether the main interaction should, for example, have more weight for certain parameters.

In some instances, there may be a (significant) difference in location between the two interactions, such as illustrated in FIG. 11*b*. The difference may be over the predetermined threshold for difference in parameters for location and/or playback time described above with respect to FIG. 10. Further, in interactions such as scenario two, described hereinabove with respect to FIGS. 5*a* and 5*b*, smooth overlapping audio object rendering system 140 may trigger the handover mode. Smooth overlapping audio object rendering system 140 may select one of the instances as the main instance to which the handover is done based on the implementation and metadata. In instances in which there is a user interaction and an extension point interaction, smooth overlapping audio object rendering system 140 may set the user interaction as the main interaction and thereby provide a most direct user experience.

In instances in which smooth overlapping audio object rendering system 140 sets a particular interaction (for example, the left-hand side interaction of FIG. 11*b*) as the main interaction, smooth overlapping audio object rendering system 140 may reduce the other interactions (for example, ramp down the right-hand side interaction) in a controlled way. Smooth overlapping audio object rendering system 140 may analyze the audio-object states and the interaction parameters to achieve the task. For example, if the playback times between the two instances are different (and smooth overlapping audio object rendering system 140 selects the playback time of the left-hand side interaction), smooth overlapping audio object rendering system 140 may mute the right-hand side instance. When smooth overlapping audio object rendering system 140 mutes the instance, the other changes may become irrelevant. However, smooth overlapping audio object rendering system 140 may determine that the playback times are also the same. In these instances, smooth overlapping audio object rendering system 140 may fuse the two instances in a way that is pleasant (for example, smooth transition, etc.) for the user and may also better indicate to the user that the two sound sources are the same. In this case, smooth overlapping audio object rendering system 140 may interpolate the location of one interaction (for example, the right-hand side interaction) smoothly between the two interactions towards the other interaction (for example, the left-hand side interaction). Similarly, smooth overlapping audio object rendering system 140 may modify the other parameters based on metadata and the specific implementation.

Smooth overlapping audio object rendering system 140 may select the main interaction based on the use case, metadata, and context-based priorities. For example, smooth overlapping audio object rendering system 140 may prioritize interactions based on the time they are triggered. Smooth overlapping audio object rendering system 140 may prioritize a user interaction over an extension point interaction. In some cases, smooth overlapping audio object rendering system 140 may discard or not use particular parameters from the main interaction (for example, not all parameters may be used (or inherited) from a main interaction). Smooth overlapping audio object rendering system 140 may have exceptions to use of parameters from the main interaction, such as the playback time as discussed above. In instances in which metadata directs or provides instructions recommending that a certain playback should not be restarted (for example, the playback under rendering should continue), smooth overlapping audio object rendering system 140 may take the playback time from an at least second interaction for the main interaction while other parameters are inherited from the first interaction.

Figure 12:
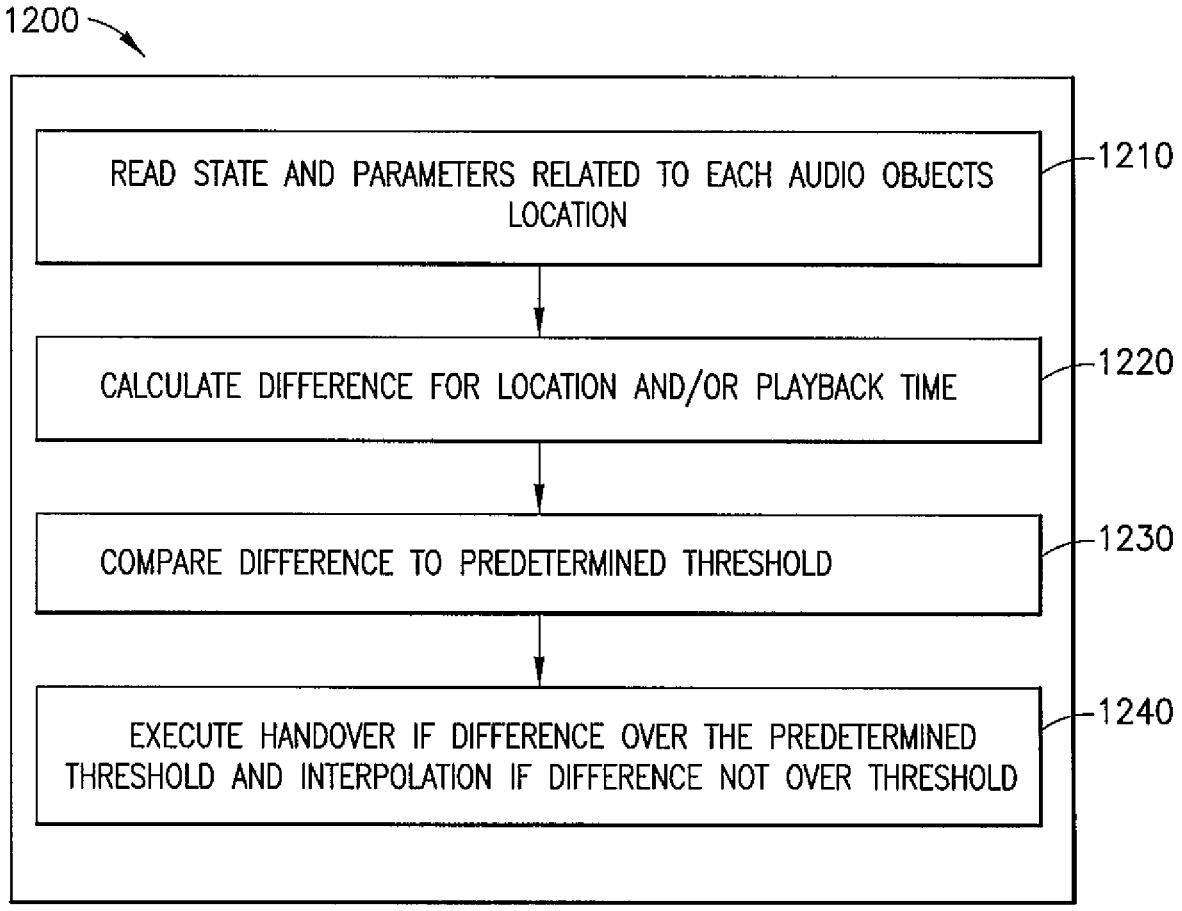
FIG. 12 is a diagram illustrating an example method.

FIG. 12 presents an example of a process of implementing smoothing of rendering of conflicting audio-object interactions.

The smoothing of rendering of conflicting audio-object interactions may be implemented in: 1) an instance of in which an audio object may have at least two simultaneous renderings that must be fused into a single rendering without discontinuities or artefacts, or 2) an instance in which at least two instances of one audio object may both have at least one rendering that is to be fused into a single rendering without discontinuities or artefacts.

At block 1210, smooth overlapping audio object rendering system 140 may read state and parameters related to an audio objects location and/or playback time for each of at least two renderings.

At block 1220, smooth overlapping audio object rendering system 140 may calculate the difference for location and/or playback time between the at least two renderings.

At block 1230, smooth overlapping audio object rendering system 140 may compare the difference to a predetermined threshold.

At block 1240, smooth overlapping audio object rendering system 140 may execute a handover if the difference exceeds the predetermined threshold. If the difference does not exceed the predetermined threshold, smooth overlapping audio object rendering system 140 may execute an interpolation.

Figure 13:
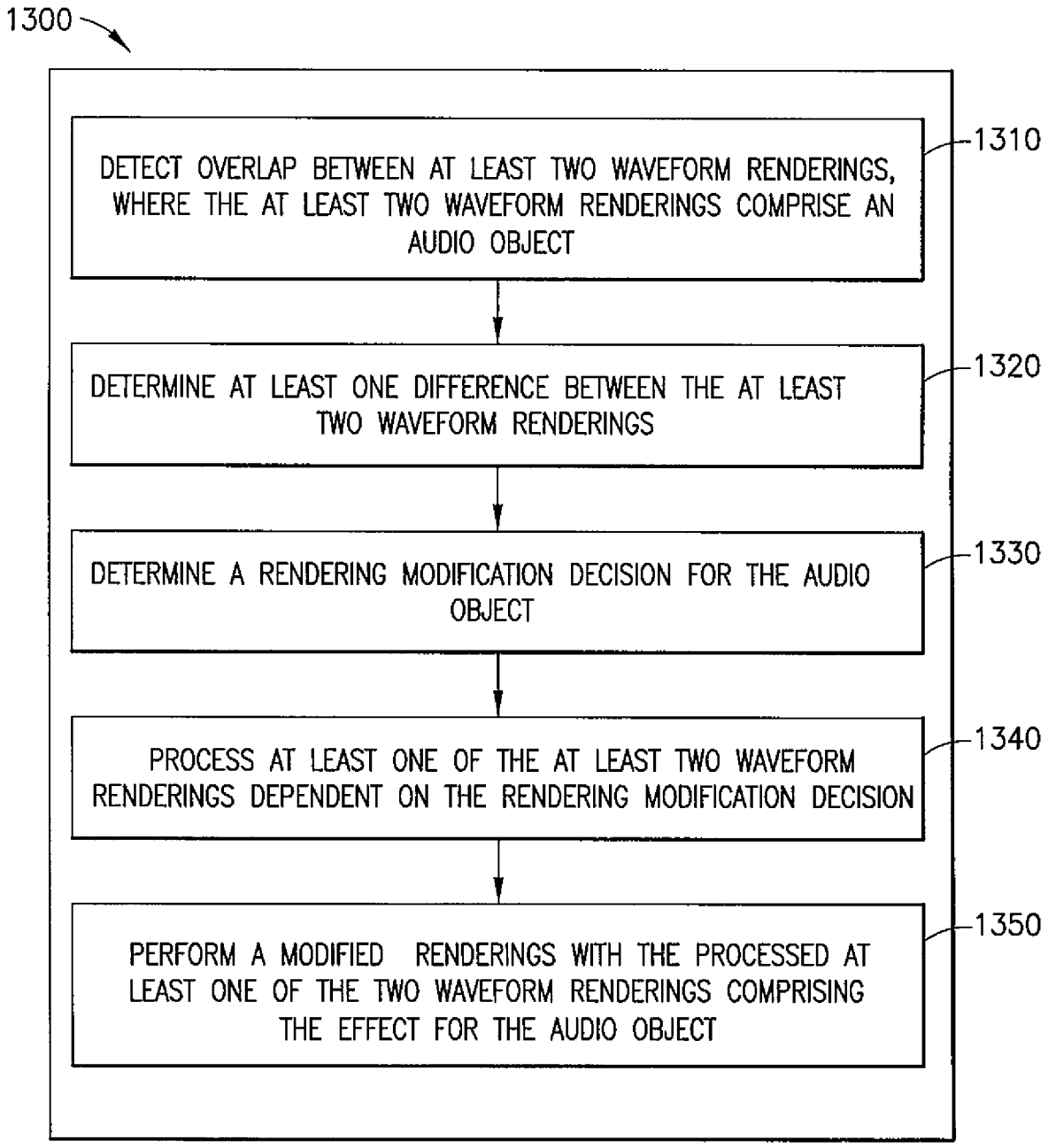
FIG. 13 is a diagram illustrating an example method.

FIG. 13 presents an example of a process of implementing smoothing of rendering of conflicting audio-object interactions.

At block 1310, smooth overlapping audio object rendering system 140 may detect an overlap between at least two waveform renderings. The at least two waveform renderings comprise an audio object.

At block 1320, smooth overlapping audio object rendering system 140 may determine at least one difference between the at least two waveform renderings for the audio object when the overlap is detected.

At block 1330, smooth overlapping audio object rendering system 140 may determine a rendering modification decision for the audio object associated with the at least one difference At block 1340, smooth overlapping audio object rendering system 140 may process at least one of the at least two waveform renderings dependent on the rendering modification decision so as to introduce an effect related to the determined at least one difference.

At block 1350, smooth overlapping audio object rendering system 140 may perform a modified rendering with the processed at least one of the at least two waveform renderings comprising the effect for the audio object.

The process of smoothing may provide technical advantages and/or enhance the end-user experience. The main advantage of the smoothing process is providing a stable, predictable, and non-disturbing user experience under overlapping audio-object interactions. For instances such as described above with respect to scenario one, the spatial stability of the rendering may be particularly improved. For instances such as described above with respect to scenario two, the process may determine a predictable response. The smoothing process also improves the toolbox available for content creators, and allows for the content creators to fine-tune the free-viewpoint VR audio use cases.

Smooth overlapping audio object rendering system 140 may determine well-defined rendering of overlapping audio-object interactions based on the smoothing process. Smooth overlapping audio object rendering system 140 may thereby prevent multiplication of audio objects or instabilities in the rendering to the user (such as rapid changes between two or more stages of audio-object interaction), and avoid the use of default responses that may work for some cases but fail for others.

Smooth overlapping audio object rendering system 140 may implement the smoothing process to provide better predictability and additional tools for content creators. Smooth overlapping audio object rendering system 140 may implement the smoothing process to control the rendering of overlapping audio-object interactions, and allow content creators to plan ahead. The smoothing process may allow the content creator to render all parts of the experience in a manner intended.

Smooth overlapping audio object rendering system 140 may improve a user experience by providing stable rendering of VR audio when audio-object interactions overlap. Smooth overlapping audio object rendering system 140 may implement the smoothing process to provide the end user a well-defined free view-point audio experiences. The user may be able to enjoy interacting with the audio objects in a way that the content creator intended.

In accordance with an example, a method may include detecting an overlap between at least two waveform renderings, wherein the at least two waveform renderings comprise an audio object, determining at least one difference between the at least two waveform renderings for the audio object when the overlap is detected, determining a rendering modification decision for the audio object associated with the at least one difference, processing at least one of the at least two waveform renderings dependent on the rendering modification decision so as to introduce an effect related to the determined at least one difference, and performing a modified rendering with the processed at least one of the at least two waveform renderings comprising the effect for the audio object.

In accordance with another example, an example apparatus may comprise at least one processor; and at least one non-transitory memory including computer program code, the at least one memory and the computer program code configured to, with the at least one processor, cause the apparatus to: detect an overlap between at least two waveform renderings, wherein the at least two waveform renderings comprise an audio object, determine at least one difference between the at least two waveform renderings for the audio object when the overlap is detected, determine a rendering modification decision for the audio object associated with the at least one difference, process at least one of the at least two waveform renderings dependent on the rendering modification decision so as to introduce an effect related to the determined at least one difference, and perform a modified rendering with the processed at least one of the at least two waveform renderings comprising the effect for the audio object.

In accordance with another example, an example apparatus may comprise a non-transitory program storage device readable by a machine, tangibly embodying a program of instructions executable by the machine for performing operations, the operations comprising: detecting an overlap between at least two waveform renderings, wherein the at least two waveform renderings comprise an audio object, determining at least one difference between the at least two waveform renderings for the audio object when the overlap is detected, determining a rendering modification decision for the audio object associated with the at least one difference, processing at least one of the at least two waveform renderings dependent on the rendering modification decision so as to introduce an effect related to the determined at least one difference, and performing a modified rendering with the processed at least one of the at least two waveform renderings comprising the effect for the audio object.

In accordance with another example, an example apparatus comprises: means for detecting an overlap between at least two waveform renderings, wherein the at least two waveform renderings comprise an audio object, means for determining at least one difference between the at least two waveform renderings for the audio object when the overlap is detected, means for determining a rendering modification decision for the audio object associated with the at least one difference, means for processing at least one of the at least two waveform renderings dependent on the rendering modification decision so as to introduce an effect related to the determined at least one difference, and means for performing a modified rendering with the processed at least one of the at least two waveform renderings comprising the effect for the audio object.

Any combination of one or more computer readable medium(s) may be utilized as the memory. The computer readable medium may be a computer readable signal medium or a non-transitory computer readable storage medium. A non-transitory computer readable storage medium does not include propagating signals and may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing.

It should be understood that the foregoing description is only illustrative. Various alternatives and modifications can be devised by those skilled in the art. For example, features recited in the various dependent claims could be combined with each other in any suitable combination(s). In addition, features from different embodiments described above could be selectively combined into a new embodiment. Accordingly, the description is intended to embrace all such alternatives, modifications and variances which fall within the scope of the appended claims.

What is claimed is:

1. A method comprising:

detecting an overlap between at least two instruction sets, where the at least two instruction sets are simultaneously applicable for determining waveform renderings of a same audio object;

determining at least one difference between at least two of the waveform renderings of the same audio object, where the determining of the at least one difference is determined with the at least two instruction sets when the overlap is detected;

determining a rendering modification decision for the same audio object, where the rendering modification decision is based, at least partially, on the determined at least one difference; and during rendering of the same audio object with at least one of the at least two instruction sets, applying a modification to a waveform rendering determined with the at least one of the at least two instruction sets, where the modification is dependent on the rendering modification decision so as to introduce an effect related to the determined at least one difference.

2. The method of claim 1, where the determining of the rendering modification decision for the same audio object further comprises:

determining the rendering modification decision based on one of a handover or an interpolation between the at least two waveform renderings, wherein the handover selects one of the at least two waveform renderings, and wherein the interpolation combines effects associated with the at least two waveform renderings.

3. The method of claim 2, where the at least two waveform renderings comprises a first waveform rendering and a second waveform rendering, and where the determining of the rendering modification decision further comprises:

receiving state and parameters based on at least one of an audio object location or an audio object playback time for the same audio object for each of the first waveform rendering and the second waveform rendering;

wherein the determining of the at least one difference between the at least two waveform renderings further comprises at least one of:

determining a difference between a first state for generating the first waveform rendering and a second state for generating the second waveform rendering, or determining a difference between a first parameter for generating the first waveform rendering and a second parameter for generating the second waveform rendering;

comparing the determined at least one difference to a predetermined threshold;

selecting the handover from one of:

a first instruction set of the at least two instruction sets configured to determine the first waveform rendering and a second instruction set of the at least two instruction sets configured to determine the second waveform rendering, and a third instruction set of the at least two instruction sets configured to determine the first waveform rendering and a fourth instruction set of the at least two instruction sets configured to determine the second waveform rendering, in response to a determination that the determined at least one difference is greater than the predetermined threshold; and selecting the interpolation between the first waveform rendering and the second waveform rendering in response to a determination that the determined at least one difference is less than the predetermined threshold.

4. The method of claim 1, where the at least two waveform renderings, further comprise:

a rendering associated with at least one user position; and a rendering associated with at least one spatial audio extension.

5. The method of claim 4, where an extension point associated with the at least one spatial audio extension is defined relative to the at least one user position.

6. The method of claim 4, where an extension point associated with the at least one spatial audio extension is defined independent of the at least one user position.

7. The method of claim 3, where the parameters for each of the at least two waveform renderings include at least one of audio object size, directivity, or audio waveform filterings.

8. The method of claim 1, further comprising:

detecting an interaction for each of the at least two waveform renderings prior to the detecting of the overlap;

determining an audio object state modification based on a change in the interaction.

9. The method of claim 8, where the change in the interaction comprises a decrease and the audio object state modification comprises an adjustment based on reversibility.

10. The method of claim 8, where the change in the interaction comprises an increase and the audio object state modification comprises an adjustment based on effective distance.

11. The method of claim 8, further comprising determining the audio object state modification based on the rendering modification decision.

12. The method of claim 1, where the at least two waveform renderings of the same audio object comprises one of:

at least two simultaneous waveform renderings, where each of the at least two simultaneous waveform renderings is determined with an instruction set of the at least two instruction sets that is applicable for determining a waveform rendering of a single instance of the same audio object, that are to be fused into a single rendering without discontinuities or artefacts, or at least two simultaneous waveform renderings, where each of the at least two simultaneous waveform renderings is determined with an instruction set of the at least two instruction sets that is applicable for determining a waveform rendering of one of at least two instances of the same audio object, that are to be fused into a single rendering without discontinuities or artefacts.

13. The method of claim 1, where the determining of the at least one difference between the at least two waveform renderings when the overlap is detected further comprises:

determining the at least one difference based on at least one of a difference in spatial position of the at least two waveform renderings or a difference in playtime of a playback of the at least two waveform renderings.

14. An apparatus comprising:

at least one processor; and at least one non-transitory memory including computer program code, the at least one non-transitory memory and the computer program code configured to, with the at least one processor, cause the apparatus to:

detect an overlap between at least two instruction sets, where the at least two instruction sets are simultaneously applicable for determining waveform renderings of a same audio object;

determine at least one difference between at least two of the waveform renderings of the same audio object, where the determining of the at least one difference is determined with the at least two instruction sets when the overlap is detected;

determine a rendering modification decision for the same audio object, where the rendering modification decision is based, at least partially, on the determined at least one difference; and during rendering of the same audio object with at least one of the at least two instruction sets, applying a modification to a waveform rendering determined with the at least one of the at least two instruction sets, where the modification is dependent on the rendering modification decision so as to introduce an effect related to the determined at least one difference.

15. An apparatus as in claim 14, where, when determining the rendering modification decision for the same audio object, the at least one non-transitory memory and the computer program code are configured to, with the at least one processor, cause the apparatus to:

determine the rendering modification decision based on one of a handover or an interpolation between the at least two waveform renderings configured to be determined with the at least two instruction sets, wherein the handover selects one of the at least two waveform renderings, and where the interpolation combines effects associated with the at least two waveform renderings.

16. An apparatus as in claim 15, where the at least two waveform renderings comprises a first waveform rendering and a second waveform rendering, and, when determining the rendering modification decision, the at least one non-transitory memory and the computer program code are configured to, with the at least one processor, cause the apparatus to:

receive state and parameters based on at least one of an audio object location or an audio object playback time for the same audio object for each of the first waveform rendering and the second waveform rendering;

wherein, to determine the at least one difference between the at least two waveform renderings further comprises at least one of:

to determine a difference between a first state for generating the first waveform rendering and a second state for generating the second waveform rendering, or to determine a difference between a first parameter for generating the first waveform rendering and a second parameter for generating the second waveform rendering;

compare the determined at least one difference to a predetermined threshold;

select the handover from one of:

a first instruction set of the at least two instruction sets configured to determine the first waveform rendering and a second instruction set of the at least two instruction sets configured to determine the second waveform rendering, and a third instruction set of the at least two instruction sets configured to determine the first waveform rendering and a fourth instruction set of the at least two instruction sets configured to determine the second waveform rendering, in response to a determination that the determined at least one difference is greater than the predetermined threshold; and select the interpolation between the first waveform rendering and the second waveform rendering in response to a determination that the determined at least one difference is less than the predetermined threshold.

17. An apparatus as in claim 16, where the at least two waveform renderings further comprise:

a rendering associated with at least one user position; and a rendering associated with at least one spatial audio extension.

18. An apparatus as in claim 14, where parameters for each of the at least two waveform renderings include at least one of audio object size, directivity, or audio waveform filterings.

19. An apparatus as in claim 14, where the at least one non-transitory memory and the computer program code are configured to, with the at least one processor, cause the apparatus to:

detect an interaction for each of the at least two waveform renderings prior to detecting the overlap; and determine an audio object state modification based on a change in the interaction.

20. A non-transitory program storage device readable with a machine, tangibly embodying a program of instructions executable with the machine for performing operations, the operations comprising:

detecting an overlap between at least two instruction sets, where the at least two instruction sets are simultaneously applicable for determining waveform renderings of a same audio object;

determining at least one difference between at least two of the waveform renderings of the same audio object, where the determining of the at least one difference is determined with the at least two instruction sets when the overlap is detected;

determining a rendering modification decision for the same audio object, where the rendering modification decision is based, at least partially, on the determined at least one difference; and during rendering of the same audio object with at least one of the at least two instruction sets, applying a modification to a waveform rendering determined with the at least one of the at least two instruction sets, where the modification is dependent on the rendering modification decision so as to introduce an effect related to the determined at least one difference.

* * * * *